US010123598B2

(12) United States Patent
Achillopoulos

(10) Patent No.: US 10,123,598 B2
(45) Date of Patent: Nov. 13, 2018

(54) PORTABLE WORK SURFACE SYSTEM FOR CARRY-ON CASES

(71) Applicant: Evangelos Achillopoulos, Alimos (GR)

(72) Inventor: Evangelos Achillopoulos, Alimos (GR)

( * ) Notice: Subject to any disclaimer, the term of this patent is extended or adjusted under 35 U.S.C. 154(b) by 107 days.

(21) Appl. No.: 14/852,784

(22) Filed: Sep. 14, 2015

(65) Prior Publication Data

US 2016/0183677 A1 Jun. 30, 2016

Related U.S. Application Data

(60) Provisional application No. 62/049,372, filed on Sep. 12, 2014.

(51) Int. Cl.
*A45C 13/28* (2006.01)
*A45C 5/14* (2006.01)
*A45C 9/00* (2006.01)

(52) U.S. Cl.
CPC ..... *A45C 5/14* (2013.01); *A45C 9/00* (2013.01); *A45C 13/28* (2013.01)

(58) Field of Classification Search
CPC .. A45C 15/00; A45C 3/10; A45C 5/02; A45C 13/28; A47B 23/001
USPC ..... 190/11, 115; 108/42, 44
See application file for complete search history.

(56) References Cited

U.S. PATENT DOCUMENTS 5,437,367 A * 8/1995 Martin ..... A45C 5/14 190/107
5,528,993 A * 6/1996 Vincelli ..... A47B 5/06 108/42
5,758,374 A * 6/1998 Ronci ..... A61G 13/101 108/152
6,439,134 B1 * 8/2002 Ryburg ..... A45C 7/00 108/42
6,736,073 B2 * 5/2004 Ryburg ..... A45C 7/00 108/42
7,950,335 B1 * 5/2011 Almond ..... A47B 23/001 108/152
8,915,197 B2 * 12/2014 Raml ..... A47B 5/00 108/152
9,332,835 B2 * 5/2016 Shannon ..... A47B 3/10
2006/0011107 A1 * 1/2006 Chang ..... A47B 57/18 108/42
2011/0163219 A1 * 7/2011 Sperry ..... A45C 13/00 248/447.2
2012/0325607 A1 * 12/2012 Webster ..... A45C 5/143 190/115

(Continued)

*Primary Examiner* — Sue A Weaver
(74) *Attorney, Agent, or Firm* — Franco S. DeLiguobi; DP IP Group

(57) ABSTRACT

The disclosure is directed to a portable work surface system for carry-on cases. In one embodiment, the system includes one or more work surfaces in the form of tables that may be removably secured to all types of carry-on cases. Each work surface forming part of the system is not only universal in its coupling to existing carry-on cases, but is also substantially dimensioned and stable enough to support various types of electronic devices, such as a portable computer, mouse, keyboards, etc. The work surface system may be adapted for use with a hard drive carry-on case having pull-out handles and wheels and configured to store a hard disk system for use in film production, for example. Additional alternative embodiments are proposed to accommodate different needs and types of uses.

17 Claims, 26 Drawing Sheets

(56) References Cited

U.S. PATENT DOCUMENTS

| | | | | |
|---|---|---|---|---|
| 2014/0238799 | A1* | 8/2014 | Sharma | B62B 1/125 190/11 |
| 2016/0037905 | A1* | 2/2016 | Glover | A47B 3/10 108/42 |
| 2016/0113388 | A1* | 4/2016 | Distefano | A47B 5/04 108/41 |
| 2016/0353877 | A1* | 12/2016 | Brus | A47B 5/02 |

* cited by examiner

PORTABLE WORK SURFACE SYSTEM FOR CARRY-ON CASES

RELATED APPLICATIONS

This application claims the benefit of U.S. Provisional Application No. 62/049,372, filed on Sep. 12, 2014, entitled "PORTABLE WORK SURFACE SYSTEM FOR CARRY-ON CASES", commonly owned and assigned to the same assignee hereof.

FIELD

The present disclosure relates to a portable work surface system for carry-on cases, and more specifically to one or more work surfaces that removably attach to a carry-on case for supporting various electronic devices, such as a portable computing device, and related components and accessories such as a mouse and/or a keyboard.

BACKGROUND

In the film and photography industries, mobile equipment carts specifically designed and constructed for supporting film and photography equipment and systems are known. For example, when a film crew goes to shoot a movie at an outdoor locations, they need to bring along portable tables, a trolley track and/or various types of rack mounted equipment carts with one or more working surface for supporting various types of filming equipment and systems, such as a portable computing device, mouse, keyboard, etc. Such available mobile equipment carts tend to be large in size and of an overall weight which makes them difficult to transport to and from movie locations. For example, existing rack mounted equipment carts require the use of tracks to move them from one location to another, thereby rendering such carts difficult to utilize. There are different ways of classifying the methods for generating augmented reality, but the end goal is always the same—to mix the virtual world with the real world.

Moreover, an increasing number of business people rely on travel in their jobs. Such individuals often find themselves spending a considerable amount of time in public places waiting for departures or arrivals. Furthermore, it is more and more common to see frequent fliers with carry-on cases and similar luggage carriers having wheels and extensible arms equipped with handles. As such, there is a need for a portable, easy to use system, which would enable a traveler to establish a portable office while waiting in airport terminals and the like, that incorporates the use of the foregoing type of carry-on case, for example.

SUMMARY

The present disclosure is directed to a portable work surface system for carry-on cases.

In one embodiment, the system includes one or more work surfaces in the form of tables that may be removably secured to all types of carry-on cases. Each work surface forming part of the system is not only universal in its coup ling to existing carry-on cases, but is also substantially dimensioned and stable enough to support various types of electronic devices, such as a portable computer, mouse, keyboards, etc.

In another embodiment, each work surface forming part of the system removably attaches to one or more vertical extensible handle support members (pull-out handles) common to a wide variety of wheeled carry-on cases by engaging outer surfaces of the pull handles. The work surfaces may be universally applied to existing handle structures, whether formed of a single or a plurality of extensible handle support members.

In another embodiment, the work surface system is particularly adapted for use with a hard drive carry-on case having pull-out handles and wheels and configured to store a hard disk system for use in film production, for example. The work surfaces of the system removably attach to one or more of the pull-out handles for supporting various electronic devices, such as a portable computer (laptop) that is used with the stored hard disk system. Hard disk systems with long battery run times (e.g., greater than 6 hours) may be employed with the system which can be easily and conveniently transported everywhere by a single person.

In yet another embodiment, the system according to any of the foregoing embodiments includes a retractable leg support mounted to the carry-on case which may be readily deployed for stabilizing the carry-on case to the ground during use of the system.

In yet another embodiment, the system according to any of the foregoing embodiments includes a canopy or tent structure that removably mounts to the carry-on case and one of the work surfaces for protecting the system from the elements, including sunlight and rain.

In an exemplary design, the tent structure is supported on one side to a cover of the carry-on case and at another side to one the work surfaces attached to the pull-out handles.

In another embodiment, the work surfaces removably attach and mate with the extensible handle support members of the carry-on case using a quick lock clamp structure. In one variation, the clamp structure may include a hand knob screw which in two turns unlocks. Another variation may include a latch. Yet another, more advanced variation may be configured to adjust for a correction angle between the work surface and the pull-out handles of the carry-on case, as described below. Another variation may additionally allow adjustment of the clamping size to permit the work surface to fit in all segments of the pullout handles, from the thinner portions to the thicker portions of the handles.

The working surfaces can be quickly mounted to the carry-on case to a desired ergonomical position. For example, the mounting height for the work surfaces can be conveniently adjusted to conform to the optimal viewing height and angle for a screen of a laptop to be supported by the work surface, or to conform to an optimal height that allows the hand of the user to fall in naturally for manipulating a mouse or track balls for color correction supported by the work surface.

In a further embodiment, the work surfaces are lightweight, yet durable in construction and are fabricated, for example, of a rigid carbon fiber material. Alternatively, the work surfaces may be made so that it is not substantially rigid, such having a construction which is foldable with small aluminum rods and a polyester fabric.

The work surfaces of the system are al so compact and easy to carry by a single person, such as in a backpack. Thus, the present disclosure provides a portable work surface system of minimum size and weight without sacrificing durability and ergonomic use. The work surface system is also more user friendly than existing rack mounted equipment carts described above.

According to the present disclosure, the work surfaces a redesigned as tables for every specific application, such as a mouse table that comes closer to the user and is rounded, and a coloring tracking ball table that has a desired angle towards the user to achieve an ergonomic position.

Additionally, the tables are configured such that a compensation angle is provided with respect to the pull-handles of the carry-on case in order for the tables to be horizontal when they are removably attached (e.g., tightened) to the pull-handle. For example, in certain existing carry-on cases, the pull-handles extend approximately at a 6 degree angle in relation to the vertical. Any known mechanism which may be manipulated by the user to adjust the angle between the work surfaces and the pull-handles may be incorporated without departing from the spirit and scope of the invention.

The system of the present disclosure is configured such that the work surfaces, in conjunction with the resulting compensation angle described above, are structured and mounted to the pull-handles such that the resulting counterweights between the carry-on case (with contents) and work surfaces (with devices supported thereon) are balanced relative one another. In alternative embodiment, the retractable leg described above may be deployed, as necessary, in case the weight of the carry-on case is insufficient to support the overall system (e.g., insufficient to counteract the weight of the work surfaces and devices supported thereon).

The work surface system for carry-on cases disclosed here in may be used in various industries, such as in the movie and photography industries as a work station for carrying and supporting electronic dev ices and systems pertinent to these industries, as well as may be used in connection with various other applications, such as a work station for use by travelers at airports (e.g., to support computing dev ice such as a laptop), for military use by military personnel, for use during sporting events, for use during musical concerts, and for use during fundraising events, for example, without departing from the spirit and scope of the invention.

DETAILED DESCRIPTION

The word "exemplary" is used herein to mean "serving as an example, instance, or illustration." Any embodiment described herein as "exemplary" is not necessarily to be construed as preferred or advantageous over other embodiments. It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms "a", "an" and "the" include both singular and plural referents, unless the context clearly dictates otherwise. Thus, for example, "a system" or "a device" includes one system or device as well as plural systems or devices.

The present disclosure is directed to a portable work surface system for carry-on cases, and particularly to a unique combination of one or more work surfaces in the form of tables that may be removably secured to all types of carry-on cases. Exemplary embodiments of the work surface system of the present invention are described in conjunction with FIGS. 1-26 discussed below, wherein like numerals represent like elements throughout the figures.

Figure 1:
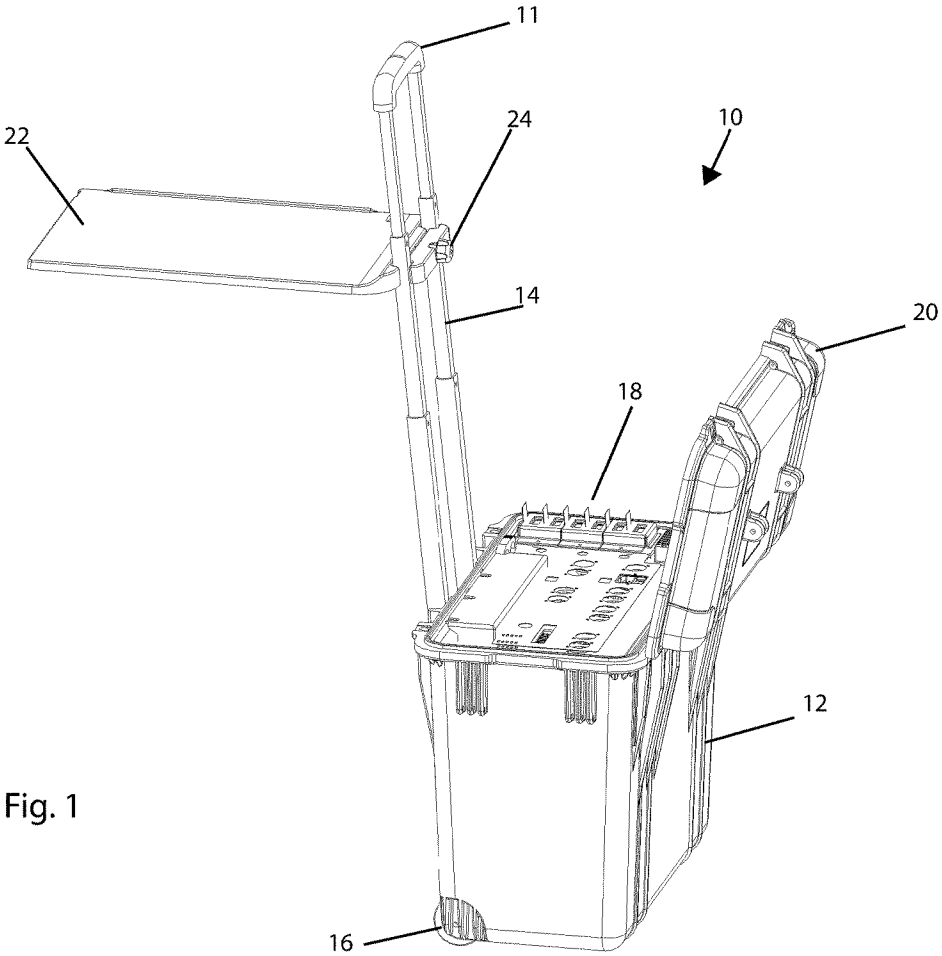
FIG. 1 shows a perspective view of a work surface system for a carry-on case according to an exemplary embodiment of the present invention.
Figure 2:
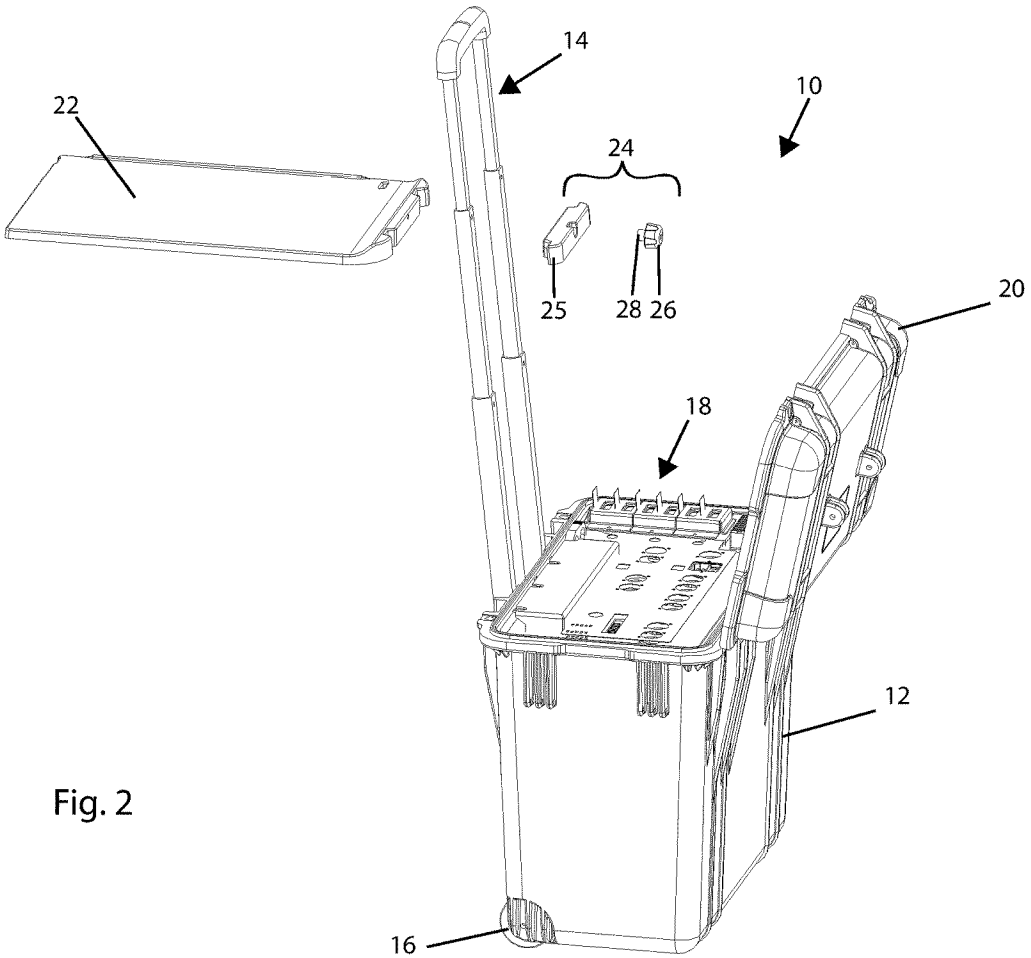
FIG. 2 shows a partially exploded perspective view of FIG. 1.
Figure 3:
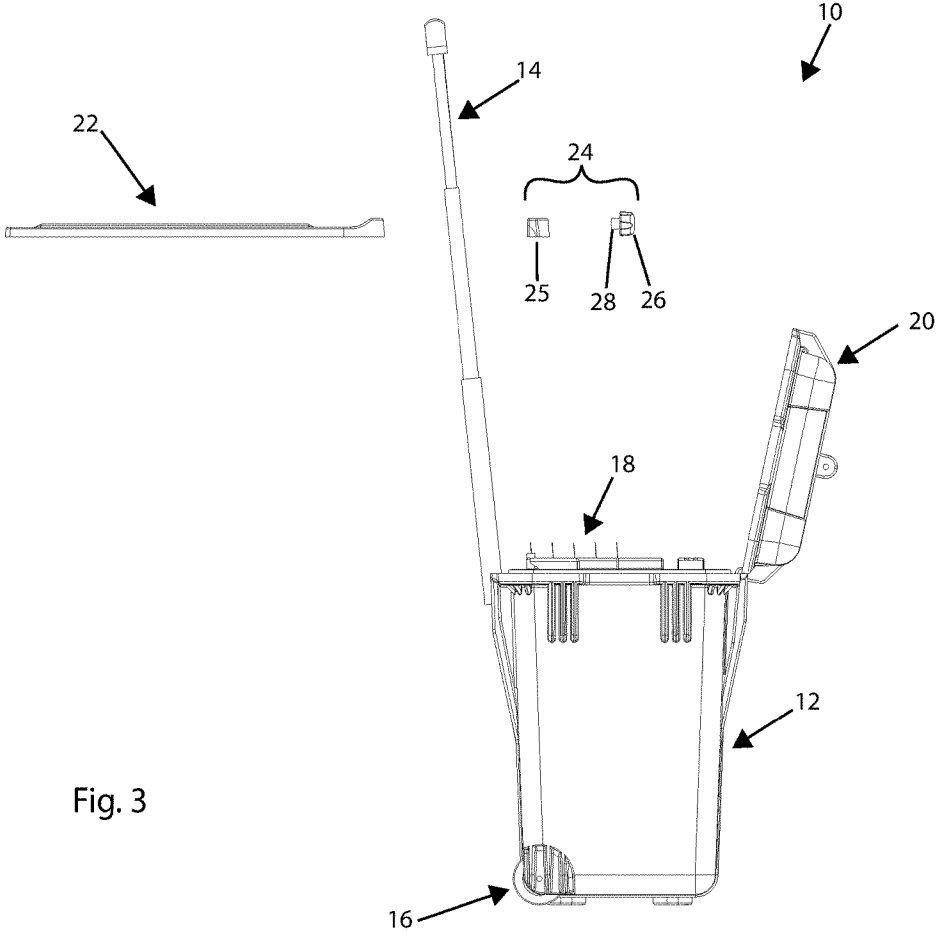
FIG. 3 is a side view of the work surface system in FIG. 2.
Figure 4:
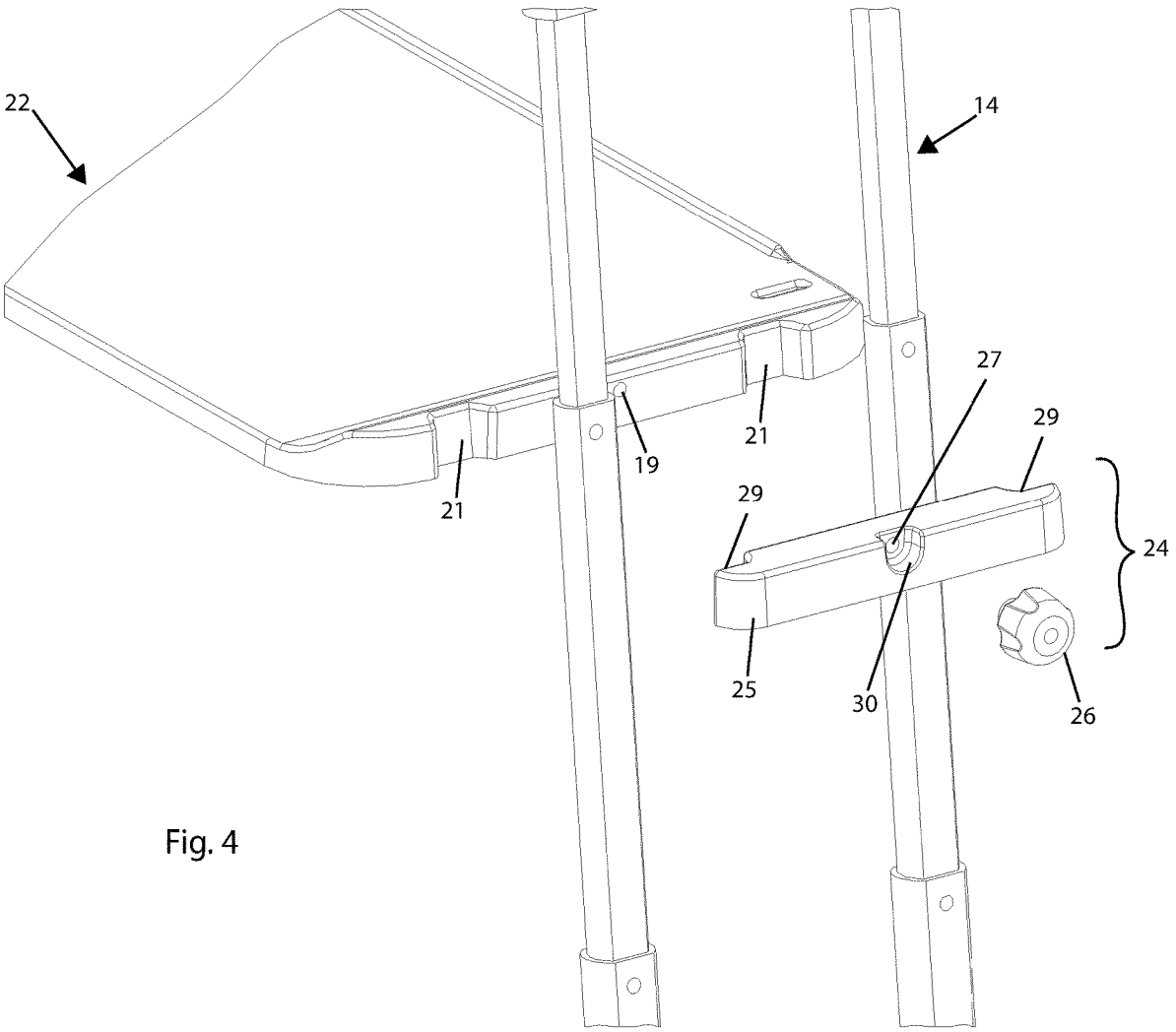
FIG. 4 is a close-up, exploded perspective view of the work surface system in FIG. 2 showing a connecting structure for removably attaching a work surface to extensible handle support members (pull-out handles) of the carry-on case.
Figure 5:
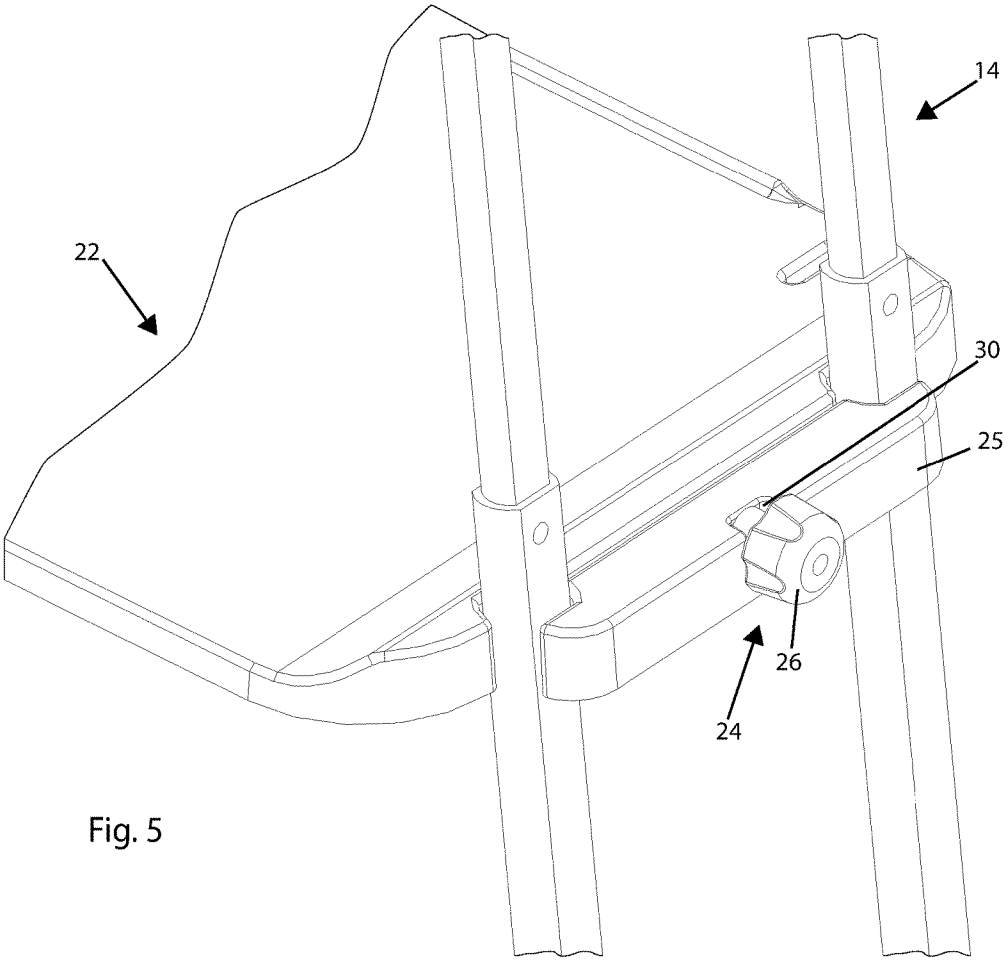
FIG. 5 is a view similar to FIG. 4, but showing the work surface removably attached to the pull-out handles of the carry-on case.

FIGS. 1-5 show an exemplary embodiment of the work surface system, generally designated at 10, according to the present invention. FIG. 1 is a perspective view of the work surface system 10, FIG. 2 is a partially exploded perspective view of FIG. 1, FIG. 3 is a side view of the work surface system in FIG. 2, FIG. 4 is a close-up, exploded perspective view of the work surface system in FIG. 2 showing a connecting structure for removably attaching a work surface to extensible handle support members (pull-out handles) of the carry-on case, and FIG. 5 is a view similar to FIG. 4, but showing the work surface removably attached to the pull-out handles of the carry-on case.

The embodiment in FIGS. 1-5 includes a work surface 22 removably attached to two vertical extensible handle support members (pull-out handles) 14 of a carry-on case and which form part of a retractable handle assembly with a handle portion 11 for pulling the carry-on case as it rides on wheels 16 of a wheel assembly mounted at a bottom rear corner of a case 12 provided with a lid 20.

In the embodiment of FIGS. 1-5 and the further exemplary embodiments described below, the carry-on case is shown with two pull-out handles 14. It will be appreciated, however, that more or fewer than two pull-out handles may be present. Likewise, in the exemplary embodiments described herein, the case 12 is configured to securely hold and store therein any of a variety of electronic devices and equipment denoted at 18, such as a hard disk system for use with a portable computing device (e.g., laptop) supported by the work surface 22, for example, as further described below. When the case stores a hard disk system, the carry-on case is particularly adapted for use in the movie industry field as a portable work station by operators of movie making equipment, including a computing device, mouse, keyboard, and/or a track balls attachment for movie color correction.

The work surface 22 is removably attached to pull-out handles 14 through a connecting structure that includes an engaging means 24 comprised of a hand knob 26 and mounting member 25 that engage corresponding portions of work surface 22, including threaded hole 19 and mating notched recesses 21 (FIG. 4), with pull-out handles 14 interposed there between (FIG. 5) to removably attach work surface 22 to pull-out handles 14.

Referring specifically to FIGS. 4-5, the mounting member 25 is provided with notched recesses 29 at end portions thereof configured to engage one side of corresponding portions of pull-out handles 14, and a generally central notched recess 30 provided with a smooth bore 27 configured to receive there through a threaded element 28 integral with hand knob 26. Work surface 22 is also provided at a side thereof with notched recesses 21 configured to engage an opposite side of corresponding portions of pull-out handles 14, as shown in FIG. 5. The work surface 22 is also provided with a threaded bore 19 configured to receive and be threadedly engaged with threaded element 28 of hand knob 26 to releasably securely attach work surface 22 to pull-out handles 14 in the manner shown in FIG. 5. Attachment of work surface 22 to pull-out handle 14 the carry-on case can be readily achieved by turning and tightening hand knob 26 to bring mounting member 25 and work surface 22 towards one another with pull-out handles interposed therebetween. Removal of work surface 22 is similarly facilitated by turning of hand knob 26 to untighten the connection.

Figure 6:
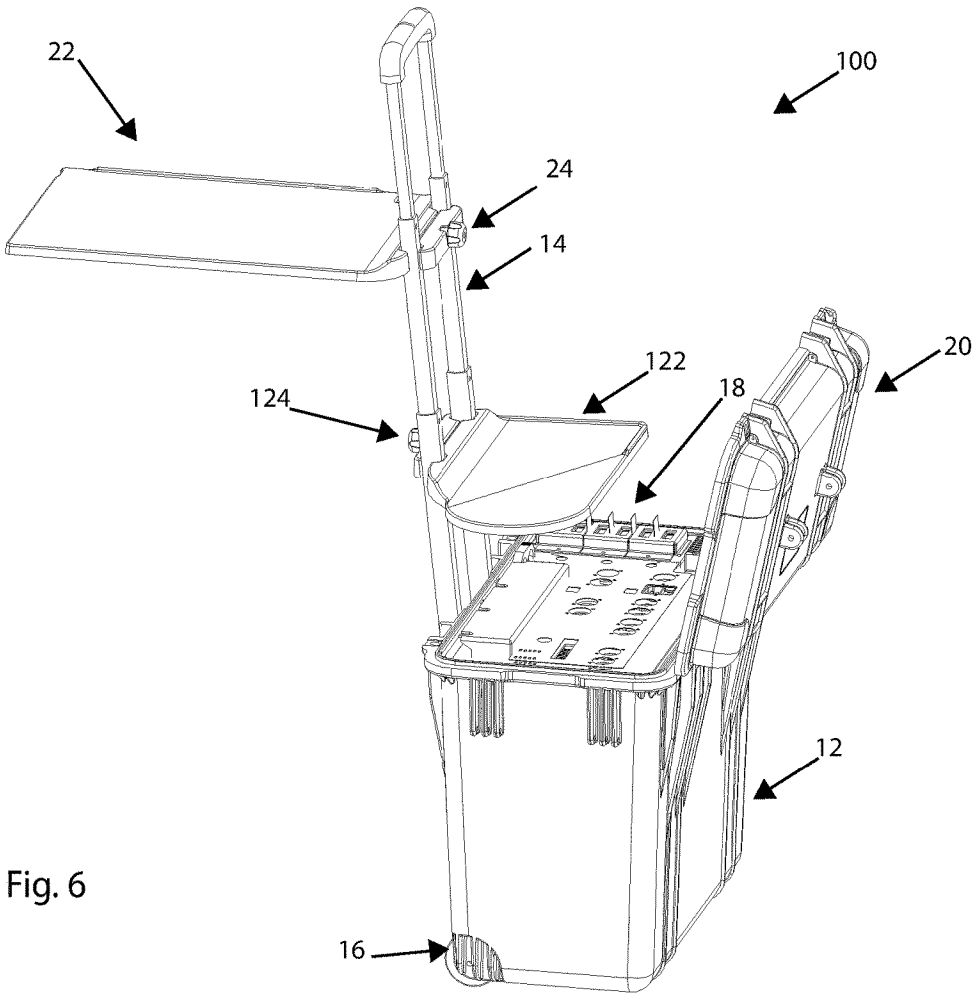
FIG. 6 shows a perspective view of a work surface system for a carry-on case according to another exemplary embodiment of the present invention showing two work surfaces mounted on pull-out handles of the carry-on case.
Figure 7:
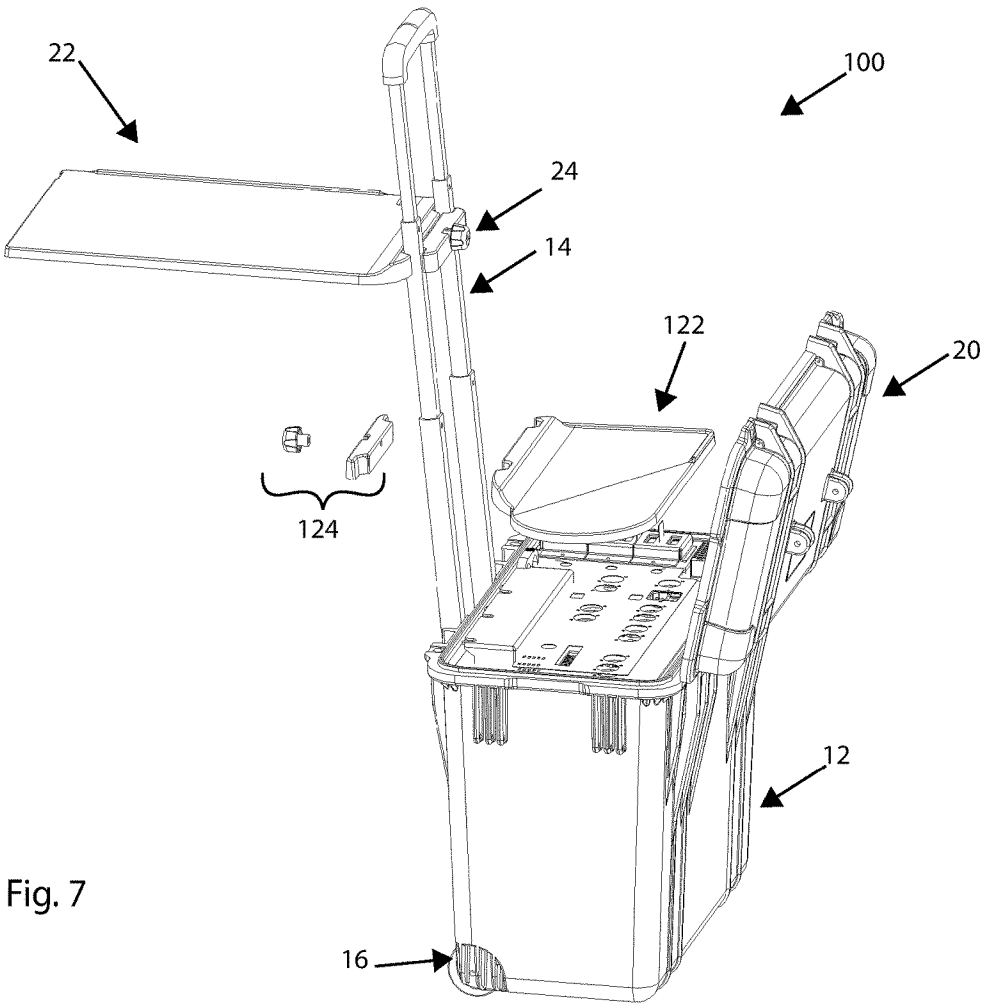
FIG. 7 shows a partially exploded perspective view of the work surface system in FIG. 6.
Figure 8:
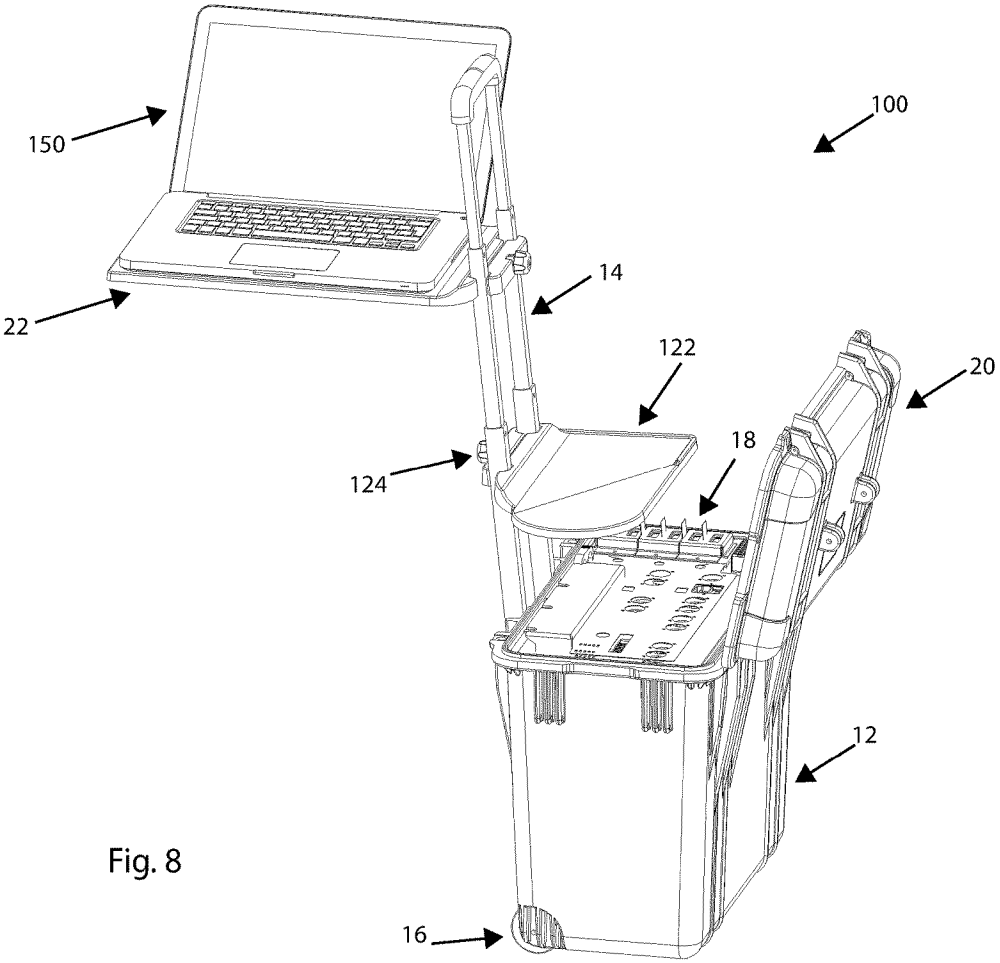
FIG. 8 is a view similar to FIG. 6 but showing a computing device (e.g., laptop) supported on one work surface of the system.
Figure 9:
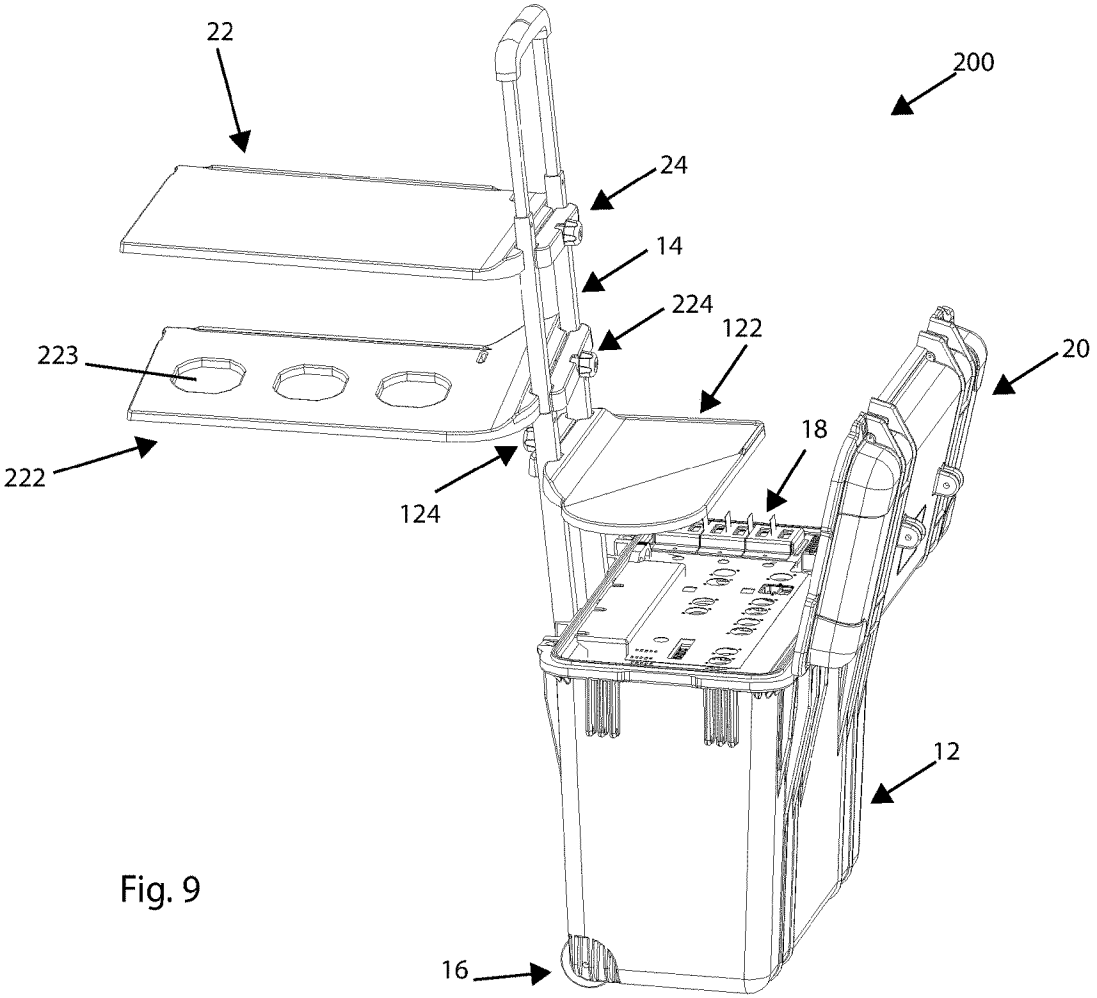
FIG. 9 shows a perspective view of a work surface system for a carry-on case according to another exemplary embodiment of the present invention showing three work surfaces removably mounted on pull-out handles of the carry-on case.
Figure 10:
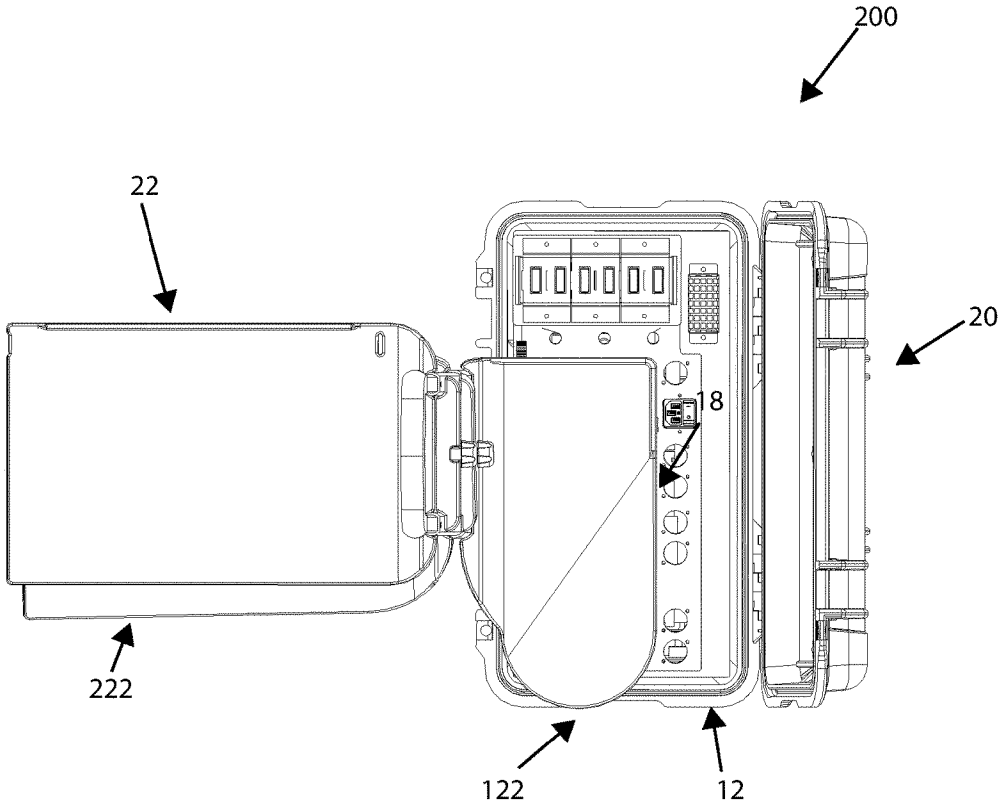
FIG. 10 is at top view of FIG. 9.
Figure 11:
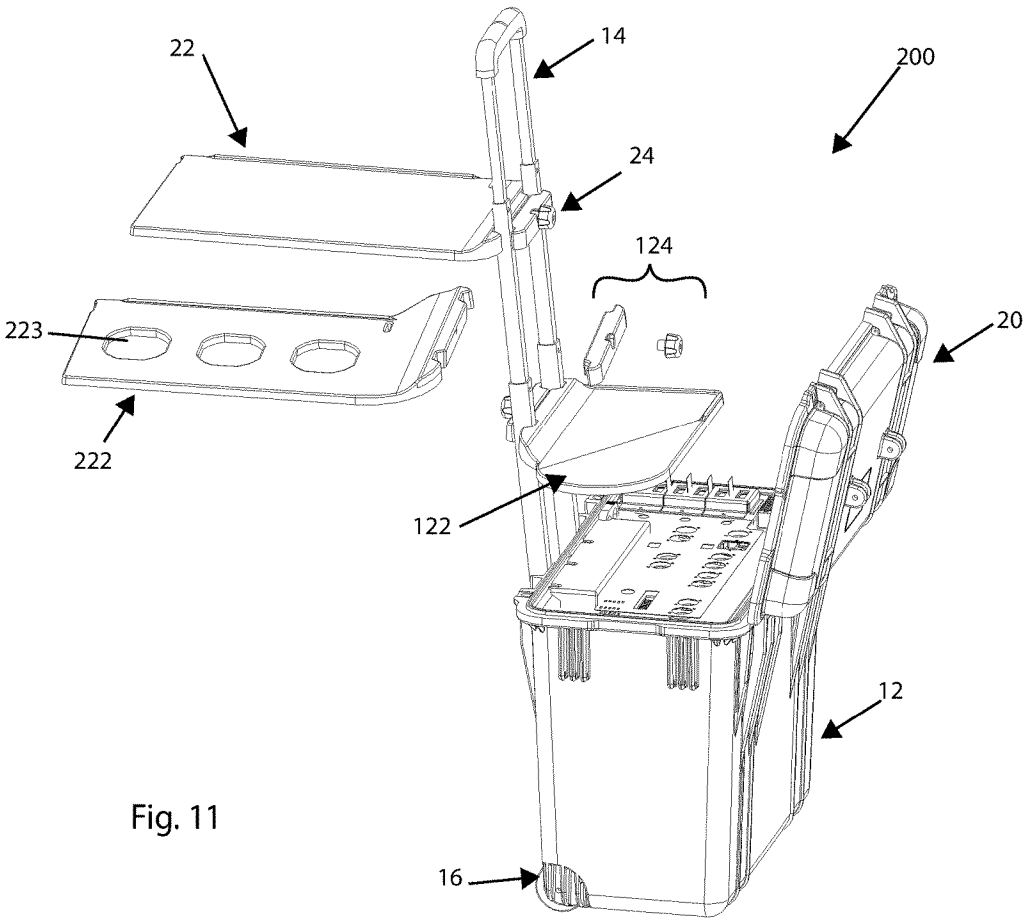
FIG. 11 is a partially exploded view of FIG. 9.
Figure 12:
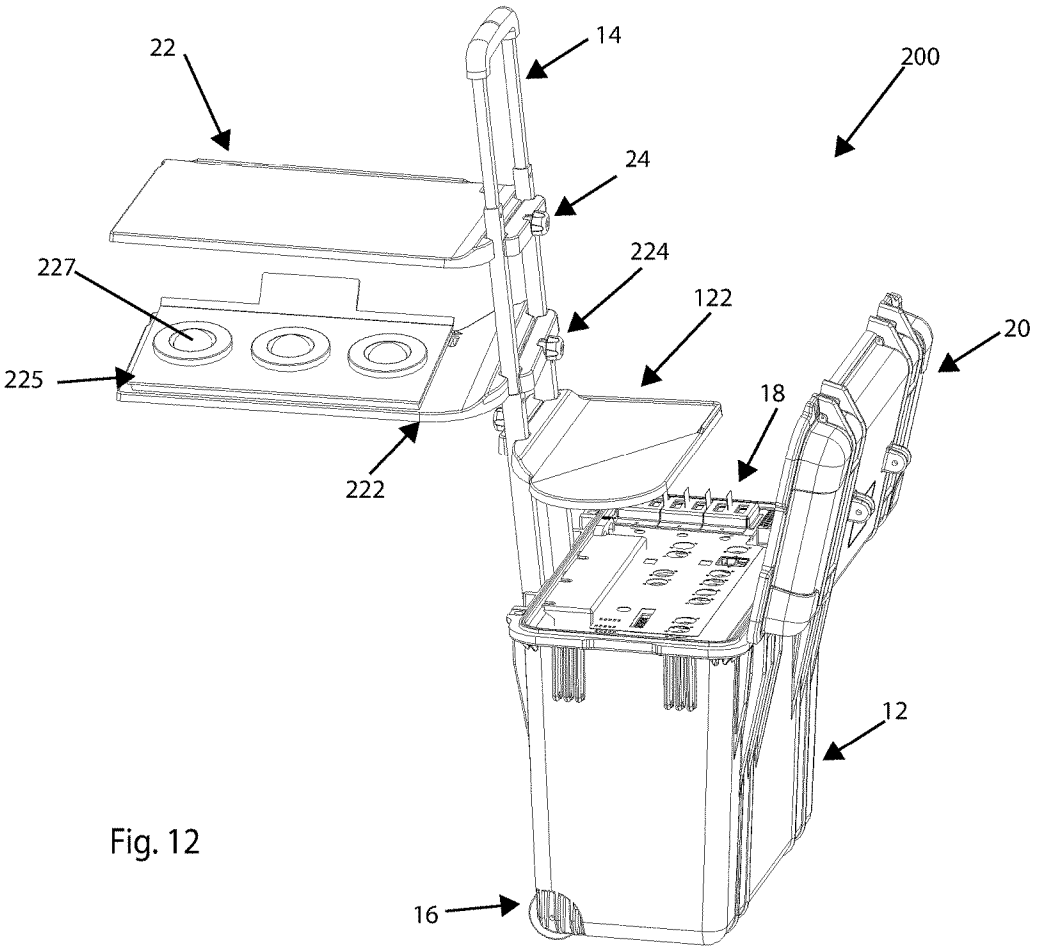
FIG. 12 is view similar to FIG. 9, but showing a tracking ball attachment for movie color correction mounted on a work surface removably attached to pull-out handles of the carry-on case.
Figure 13:
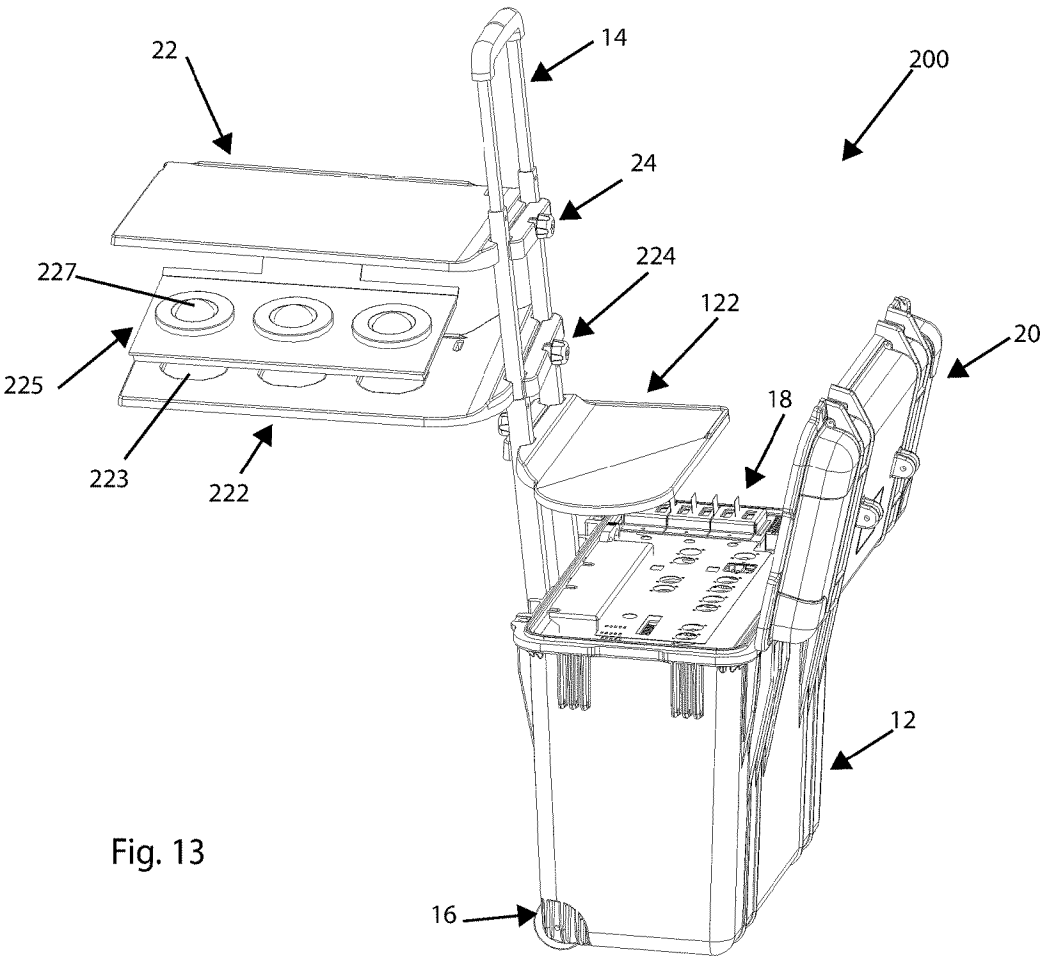
FIG. 13 is a view similar to FIG. 12, but with the tracking ball attachment shown relative to but not mounted on the work surface.
Figure 14:
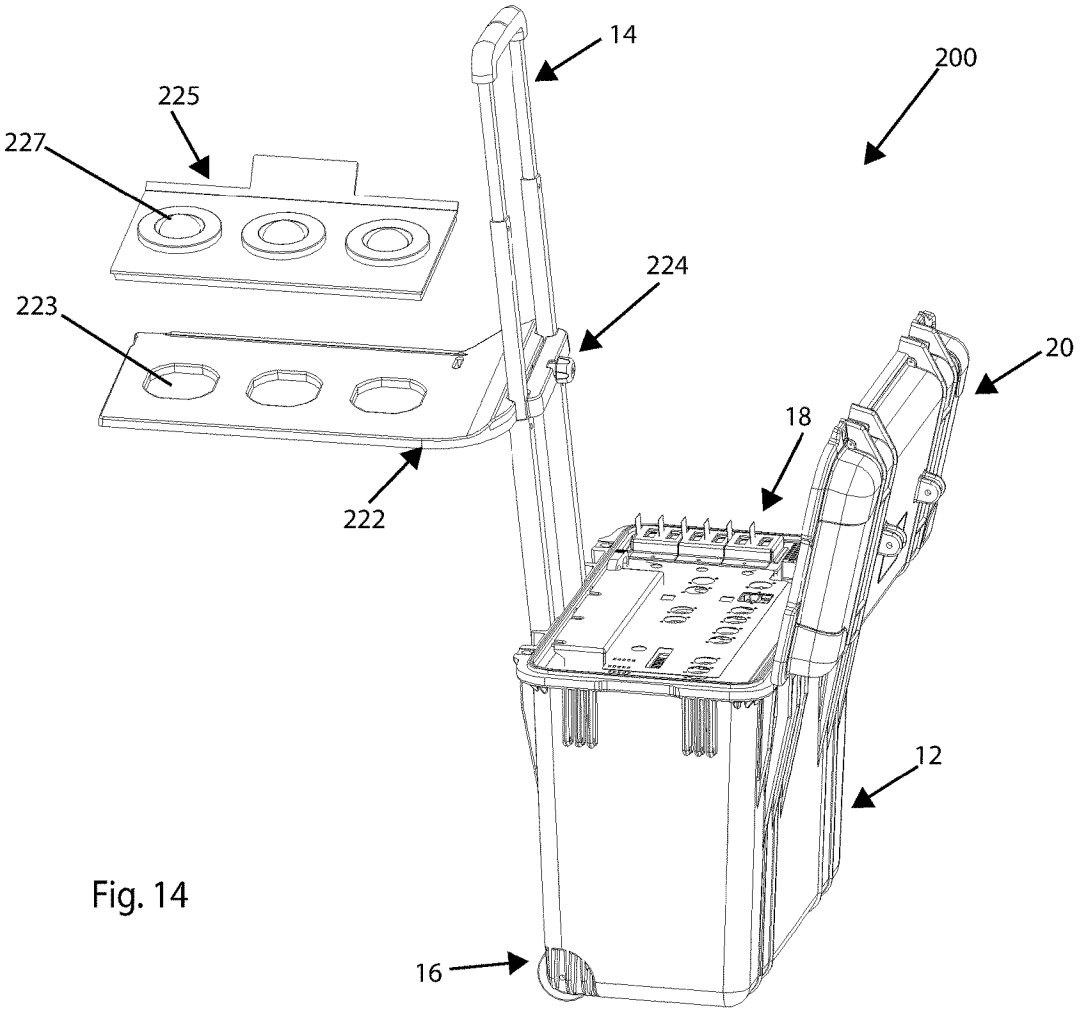
FIG. 14 is a view similar to FIG. 13, but with two of the three work surface s re moved and showing only the work surface for supporting the tracking ball attachment, with the tracking ball attachment shown removed from the work surface.
Figure 15:
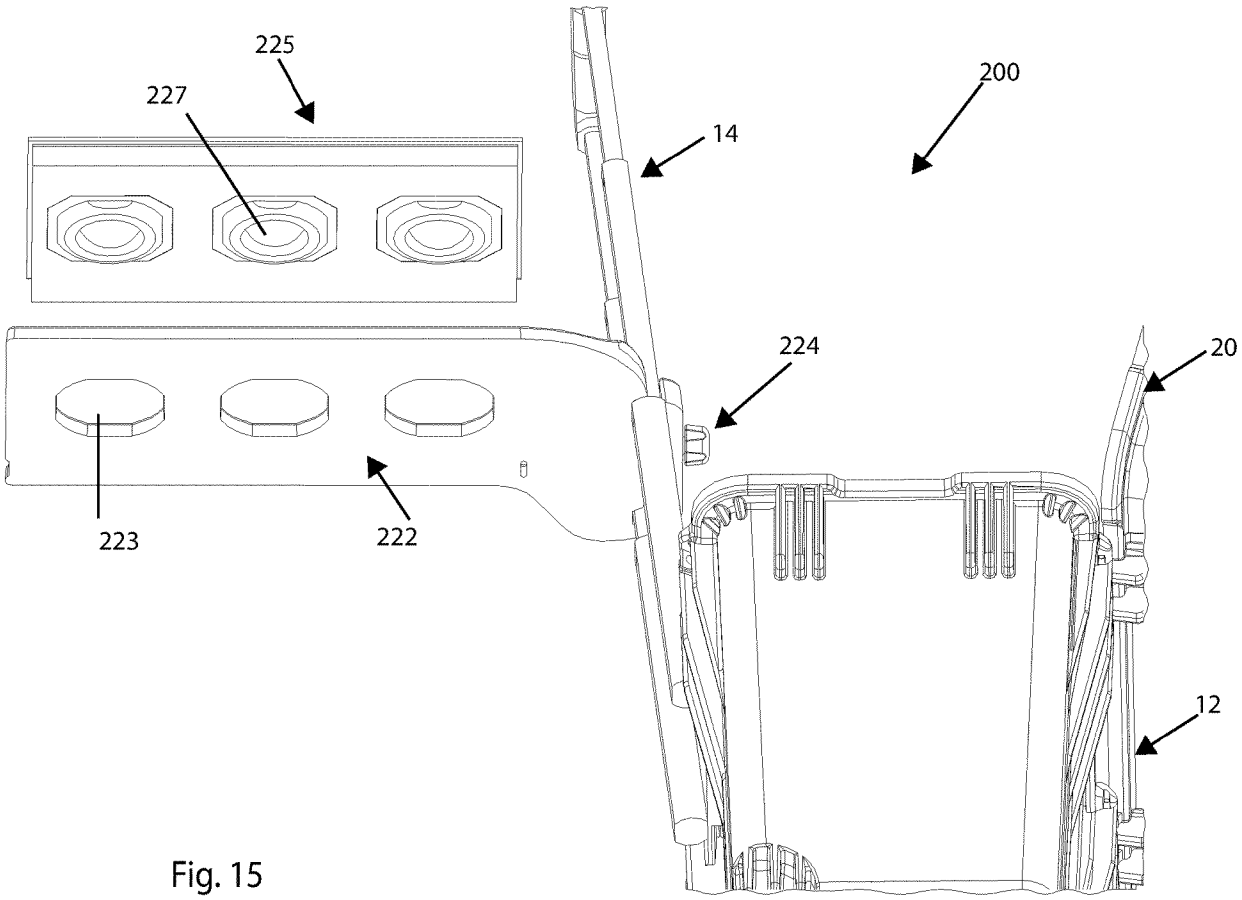
FIG. 15 is a close-up view of a section of FIG. 14 as viewed from the bottom of the work surface and tracking ball attachment.
Figure 16:
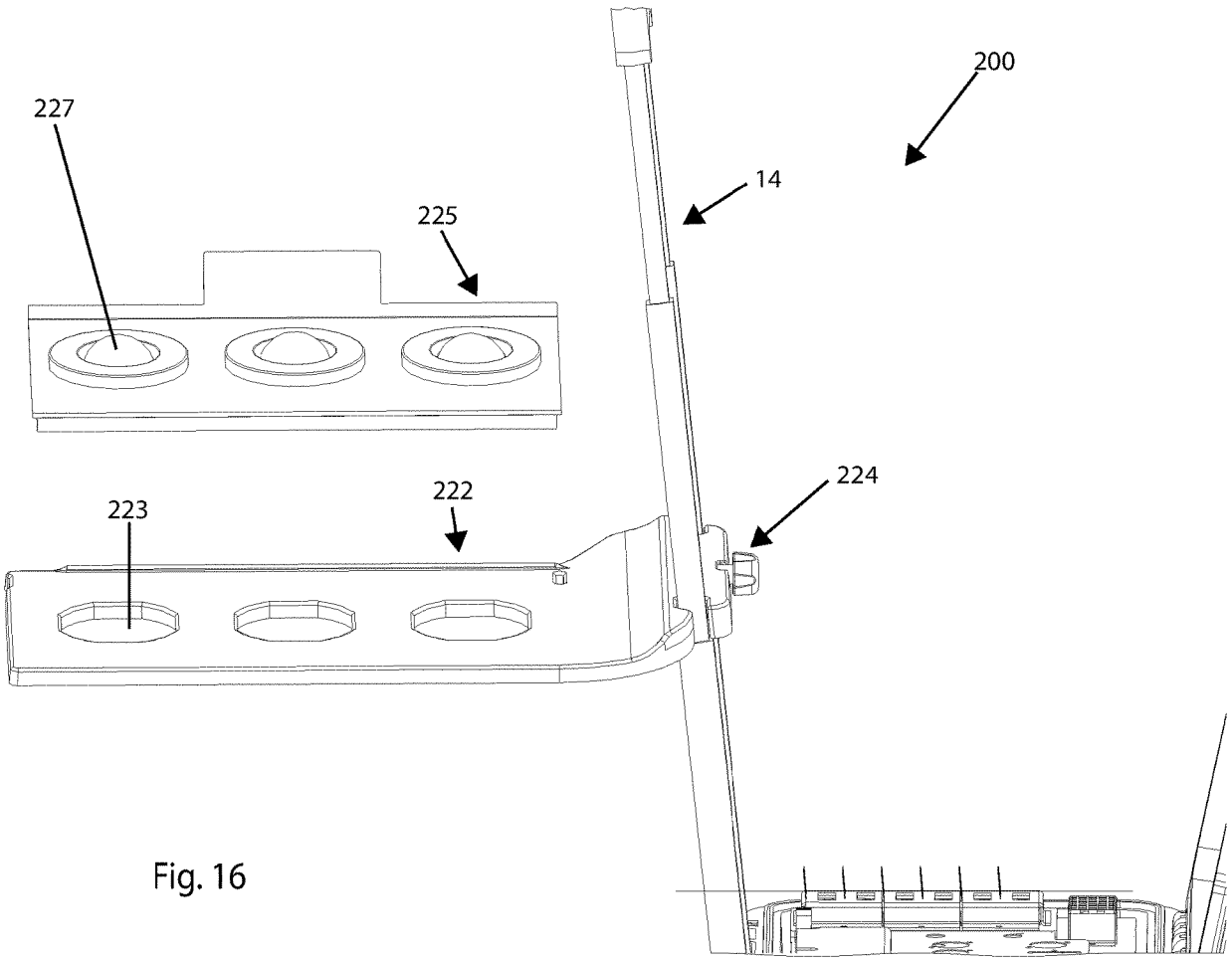
FIG. 16 is a close-up view of a section of FIG. 14 as viewed from the top of the work surface and tracking ball attachment.

FIGS. 6-8 show another exemplary embodiment of the work surface system for a carry-on case, generally designated at 100, according to the present invention. FIG. 6 is a perspective view of work surface system 100, FIG. 7 is partially exploded perspective view of the work surface system in FIG. 6, and FIG. 8 is a view similar to FIG. 6 but showing a computing device (e.g., laptop) supported on one work surface of the system.

The system 100 is the same as described above for system 10 of FIGS. 1-5, except that in system 100 a second work surface 122 has been detachably mounted to pull-out handles 14 of the carry-on case on a side of pull-out handles 14 opposite to the side thereof on which work surface 22 is mounted. The connecting structure and manner of detachably connecting and disconnecting work surface 122 to and from pull-out handles 14 is as described above for the embodiments of FIGS. 1-5. In FIGS. 6-8 the engaging means is denoted by reference numeral 124. FIG. 8 shows a laptop computer 150 placed on and supported by work surface 22.

Figure 17:
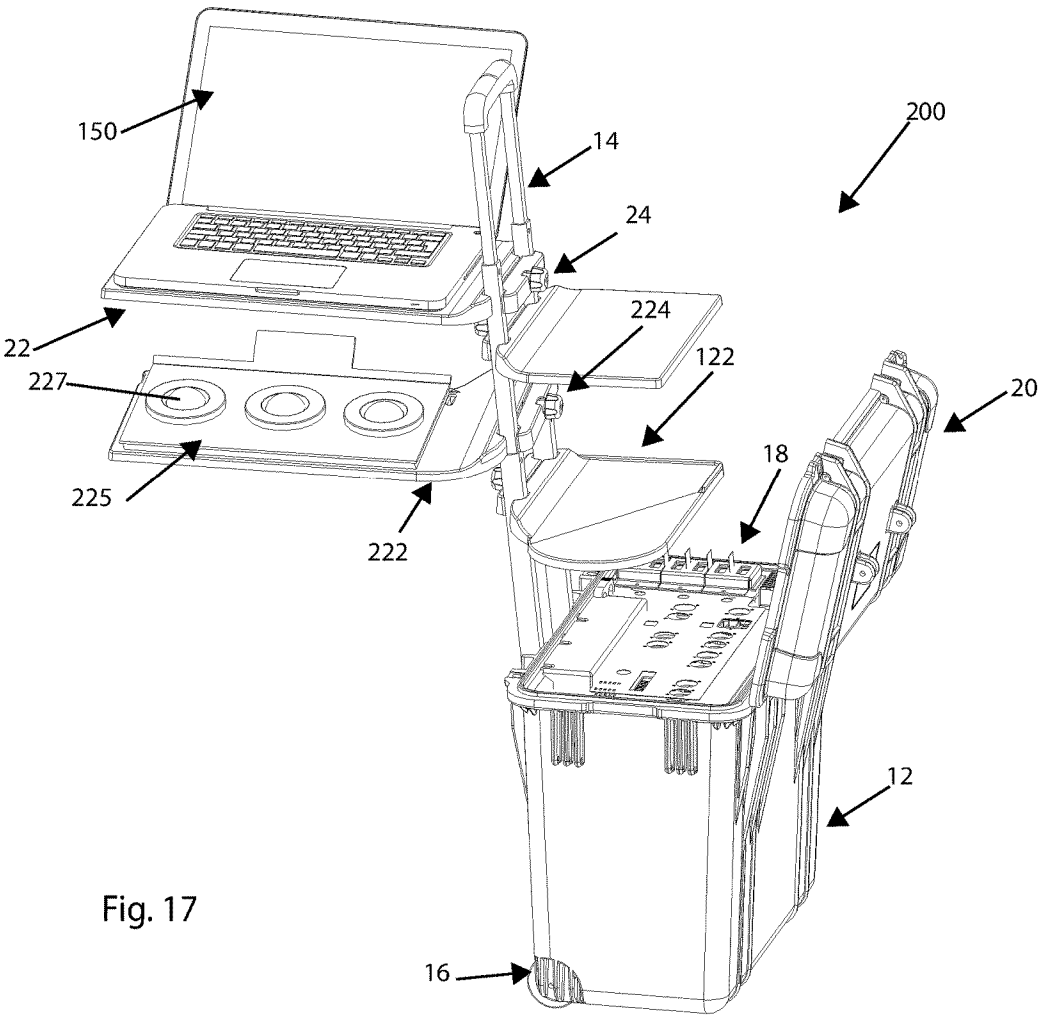
FIG. 17 is a view similar to FIG. 12, but showing a computing device (e.g., laptop) supported on one work surface of the system.

FIGS. 9-17 shows another exemplary embodiment of the work surface system for a carry-on case, generally designated at 200, according to the present invention. System 200 is the same as described above for system 100 of FIGS. 6-8, except that in system 200 a third work surface 222 has been detachably mounted to pull-out handles 14 of the carry-on case on a side of pull-out handles 14 corresponding to the side thereof on which work surface 22 is mounted (i.e., work surface 222 is mounted directly below work surface 22). Work surface 200 includes holes (three in number) 223 and is configured to receive and support a tracking ball attachment 225 with balls 227 for movie color correction (FIGS. 12-13), which attachment and its purpose and function are well known the filming industry. The connecting structure and manner of detachably connecting and disconnecting work surface 122 to and from pull-out handles 14 is as described above for the embodiments of FIGS. 1-5. In FIGS. 9-17, the engaging means is denoted by reference numeral 224. FIG. 17 shows laptop computer 150 and tracking ball attachment 225 placed on and supported by work surfaces 22, 225, respectively. Although not shown, work surface 122 is configured for supporting thereon other electronic devices, such as a mouse, or may simply serve as a surface for placing documents and other papers for reading or taking notes, for example, during use of system 200.

Figure 18:
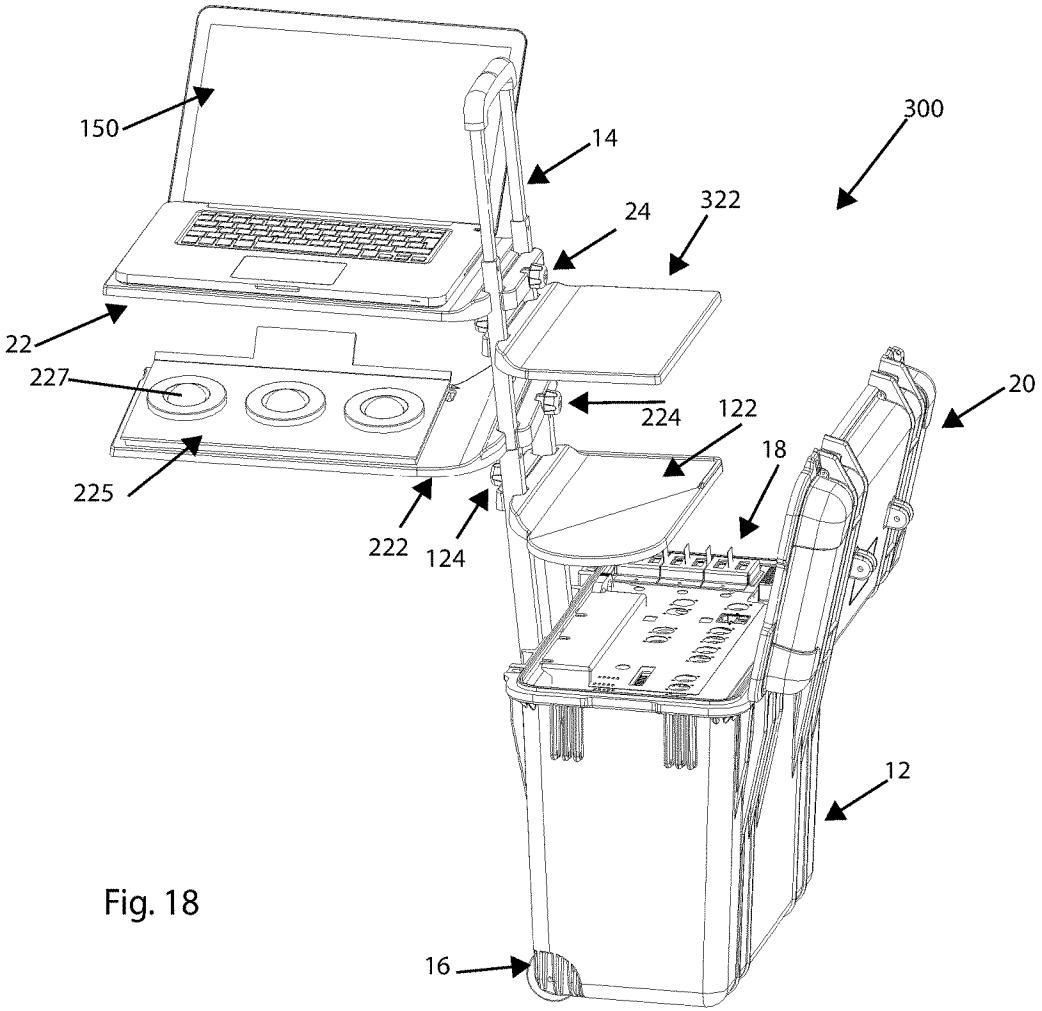
FIG. 18 shows a perspective view of a work surface system for a carry-on case according to an exemplary embodiment of the present invention showing four work surfaces removably mounted on pull-out handles of the carry-on case.
Figure 19:
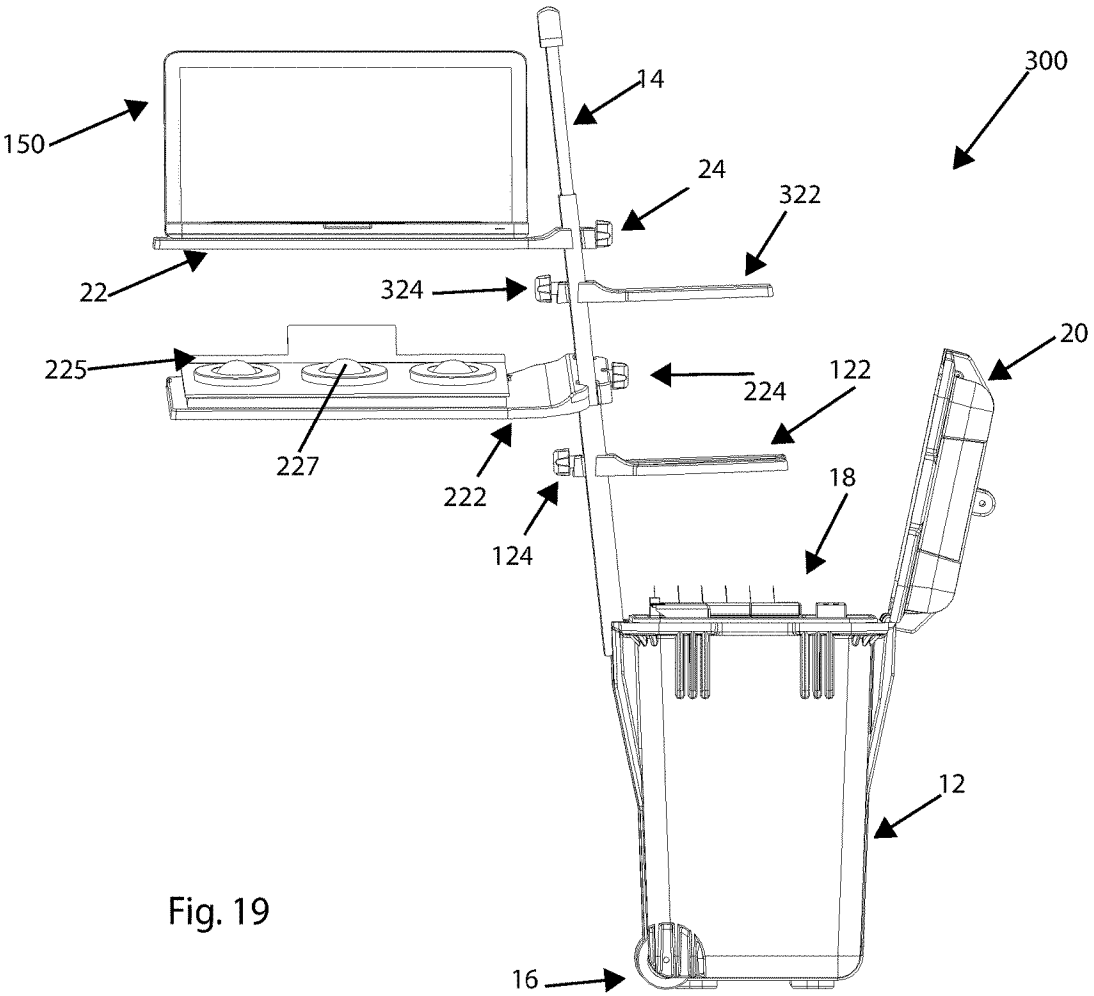
FIG. 19 is a side view of FIG. 18.
Figure 20:
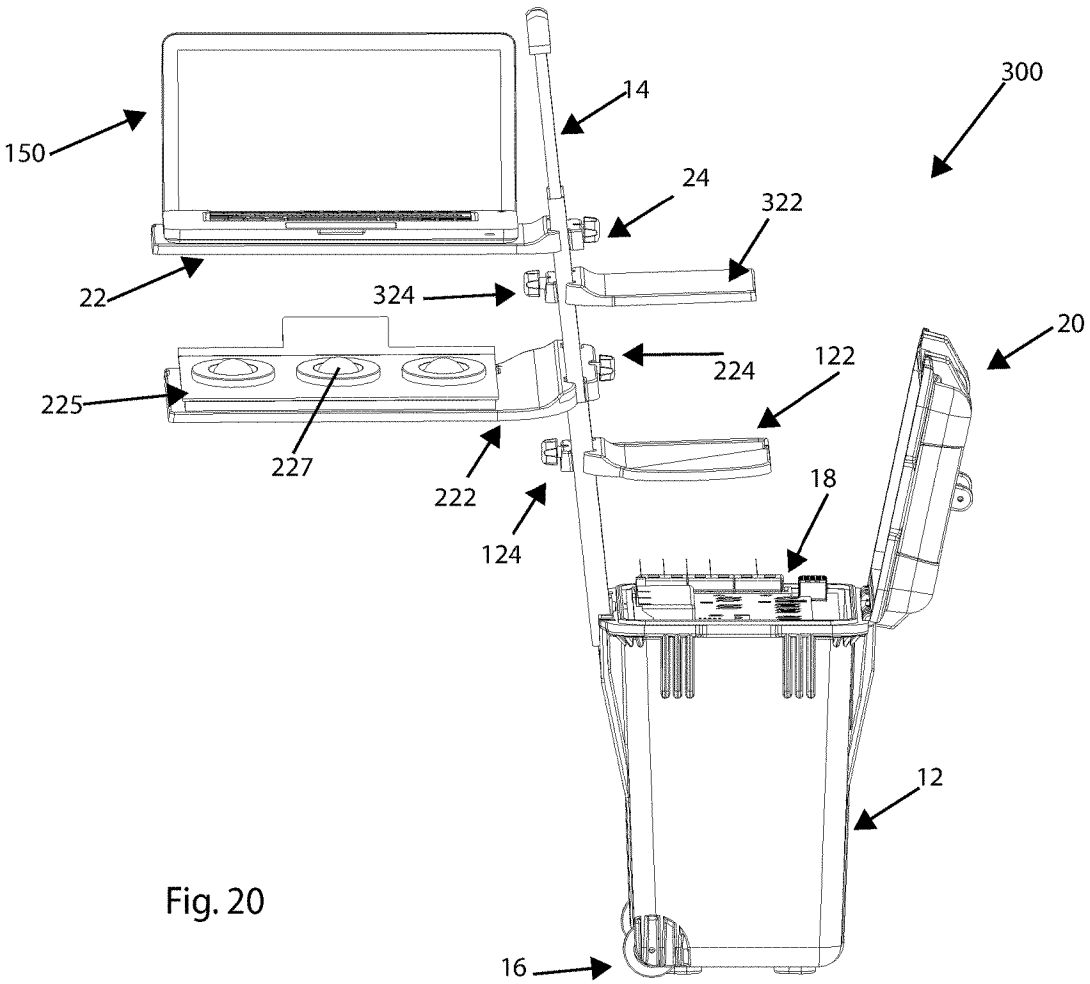
FIG. 20 is another perspective view of the work surface system shown in FIG. 18.

FIGS. 18-20 show another exemplary embodiment of the work surface system for a carry-on case, generally designated at 300, according to the present invention. System 300 is the same as described above for system 200 of FIG. 17, except that in system 300 a fourth work surface 322 has been detachably mounted to pull-out handles 14 of the carry-on case on a side of pull-out handles 14 corresponding to the side thereof on which work surface 122 is mounted (i.e., work surface 322 is mounted directly above work surface 122). The connecting structure and manner of detachably connecting and disconnecting work surface 322 to and from pull-out handles 14 is as described above for the embodiments of FIGS. 1-5. In FIGS. 18-20, the engaging means is denoted by reference numeral 324. Although not shown, work surface 322 is configured for supporting thereon other electronic devices, such as a mouse, or may simply serve as a surface for placing documents and other papers for reading or taking notes, for example, during use of system 300.

Figure 21:
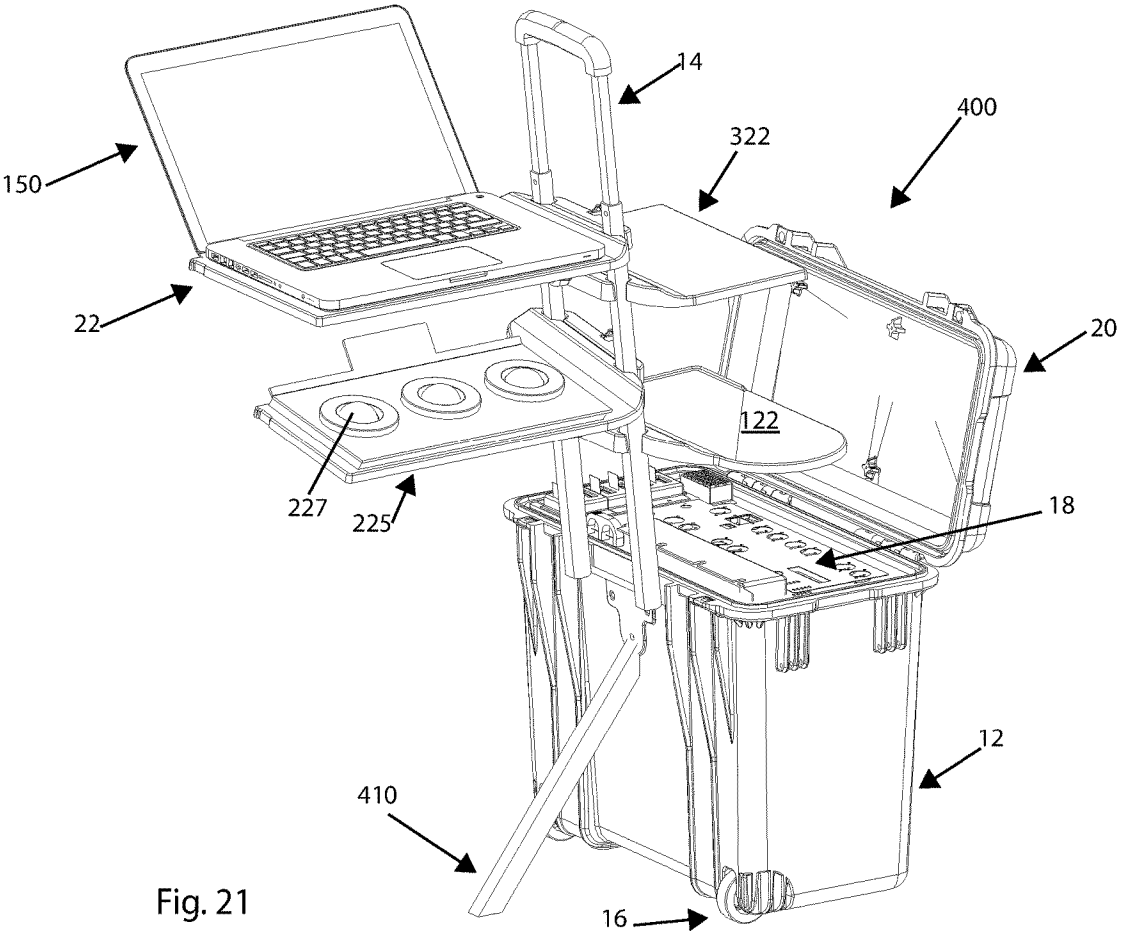
FIG. 21 is a perspective view of a work surface system for a carry-on case according to another embodiment of the present invention showing a retractable support leg structure.
Figure 22:
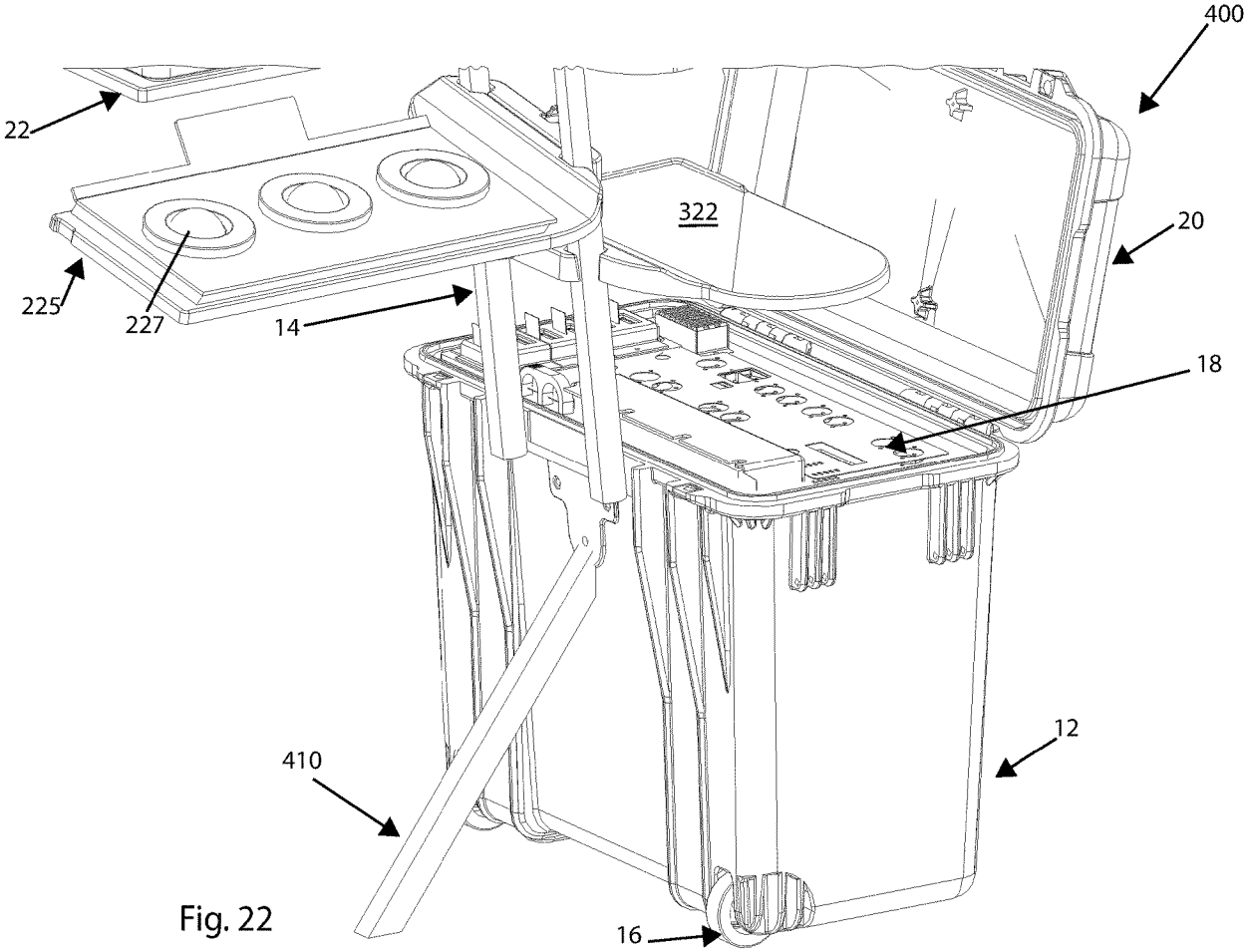
FIG. 22 is a close-up of the perspective view of the work surface system shown in FIG. 21.
Figure 23:
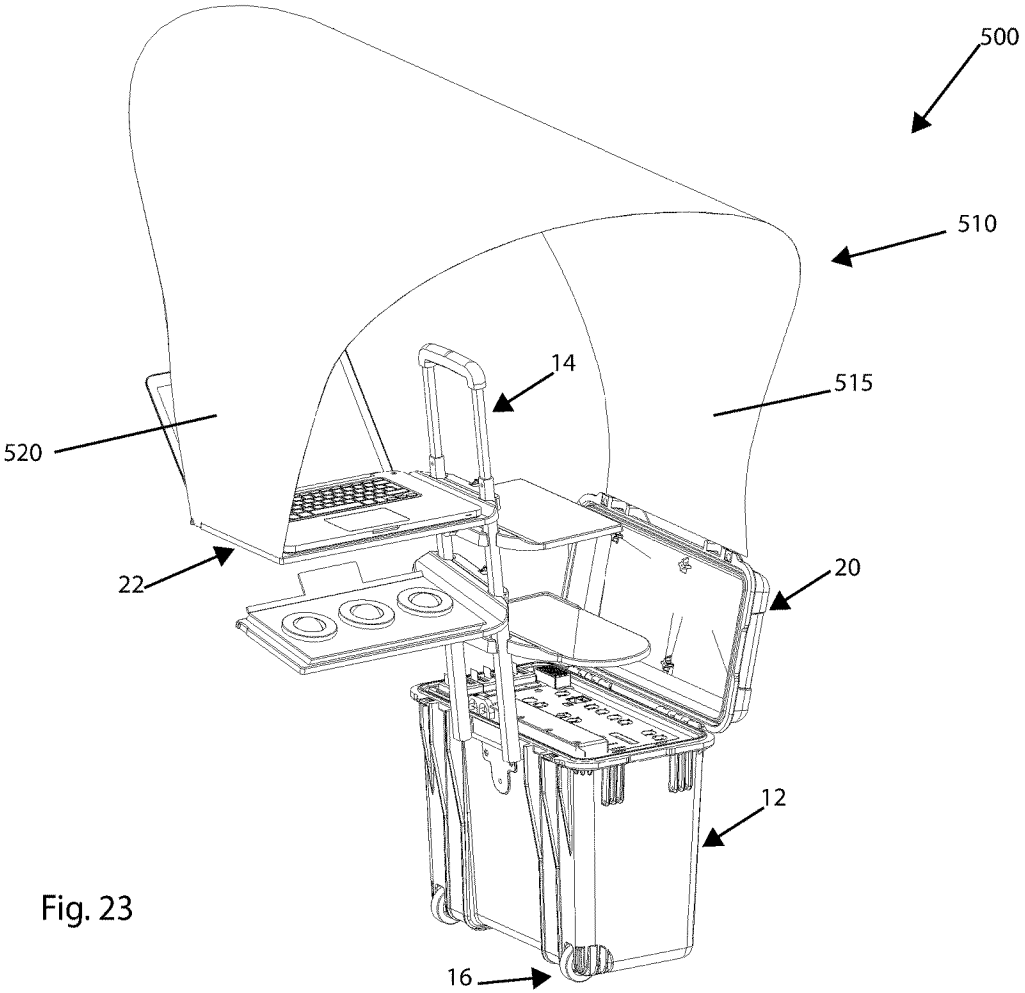
FIG. 23 is a perspective view of a work surface system for a carry-on case according to another embodiment of the present invention showing a tent mounted to a lid of the carry-on case and to a work surface.
Figure 24:
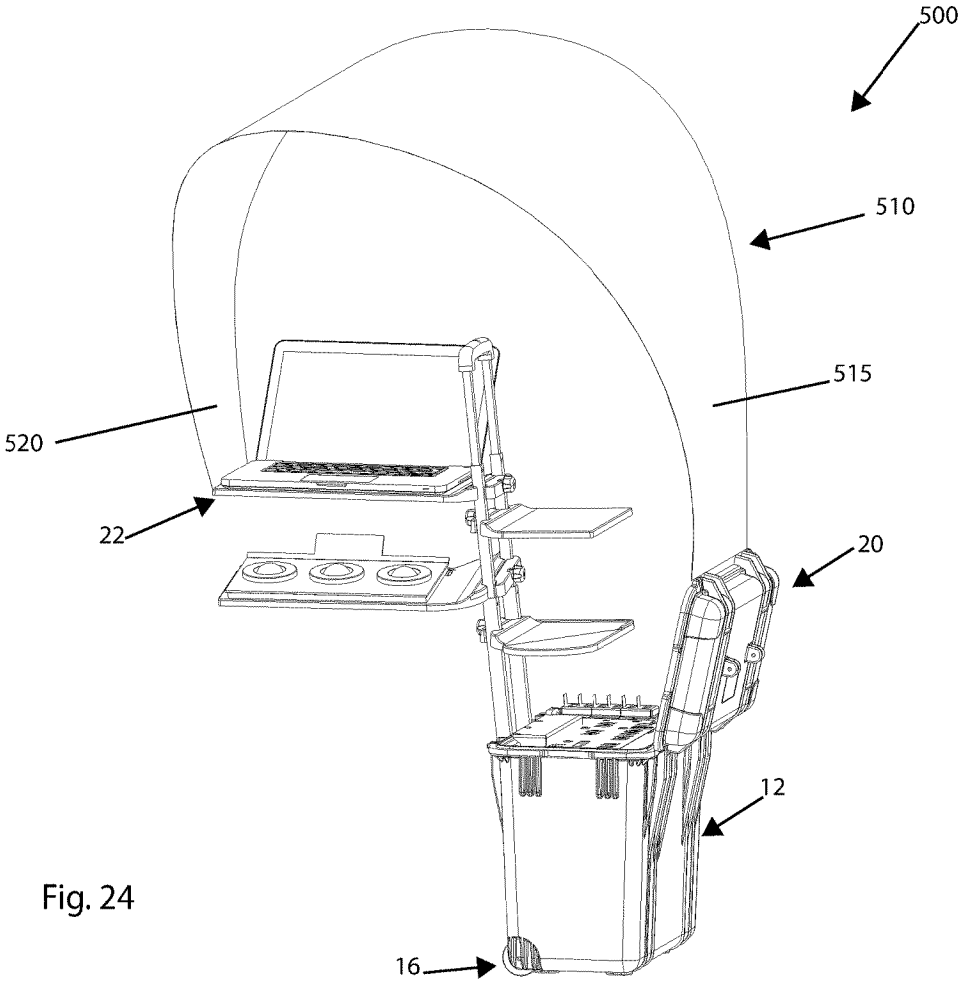
FIG. 24 is another perspective view of the work surface system shown in FIG. 23.

FIGS. 21-22 show another exemplary embodiment of the work surface system for carry-on cases, generally designated at 400, according to the present invention. System 400 is the same as described above for system 300 of FIGS. 18-20, except that system 400 further includes a leg support 410 having one end securely mounted to case 12 and another end anchored to a surface on which case 12 rests. Leg support 410 functions to stabilize system 400 during use to prevent the carry-on case from tilting over (i.e., to the left in FIG. 21) when the total weight of case 12 with content 18 and work surfaces J22, 322 on one side of pull-out handles 14 is less than the total weight of work surfaces 22, 225 and corresponding devices (e.g., laptop 150, tracking ball attachment 225) on the other side of pull-out handles 14. Additionally, leg support 410 also counteracts any force exerted by the tilted angle of the carry-on case in the state as shown in FIG. 21, for example, which produces a force tending to tilt the carry-on case in a direction to the left in FIG. 21. Thus leg support 410 constitutes means for counteracting a force exerted by system 400 tending to tilt in a direction opposite to the support force provided by leg support 410. Although details are not shown, leg support 410 may be hinged relative to case 12 or attached to case 12 in any manner known in the art such that leg support 410 may be readily deployed from a stored state to the state during use as shown in FIGS. 21-22.

Figure 25:
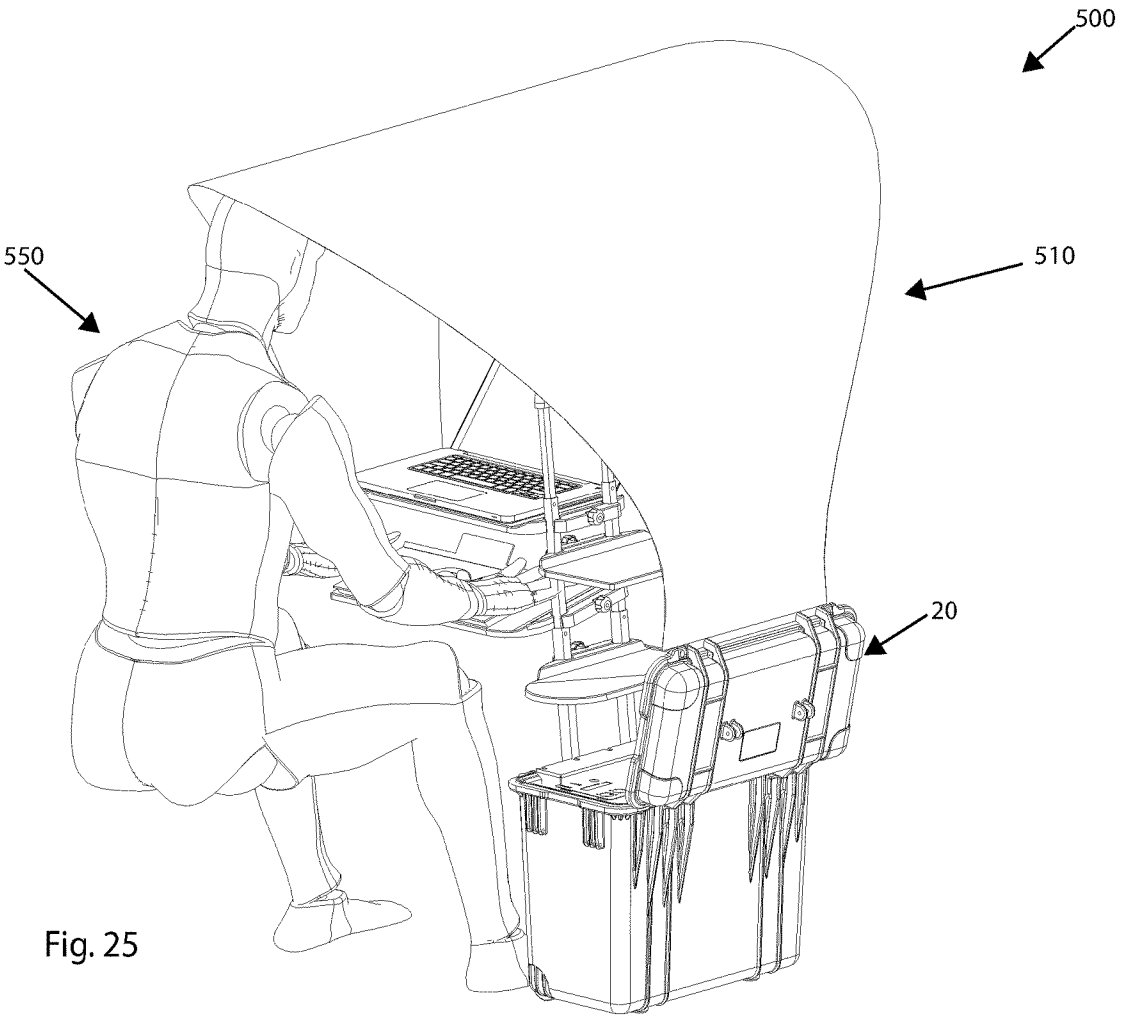
FIG. 25 is another perspective view of the work surface system shown in FIG. 23, with a user of the work surface system shown in a working position.
Figure 26:
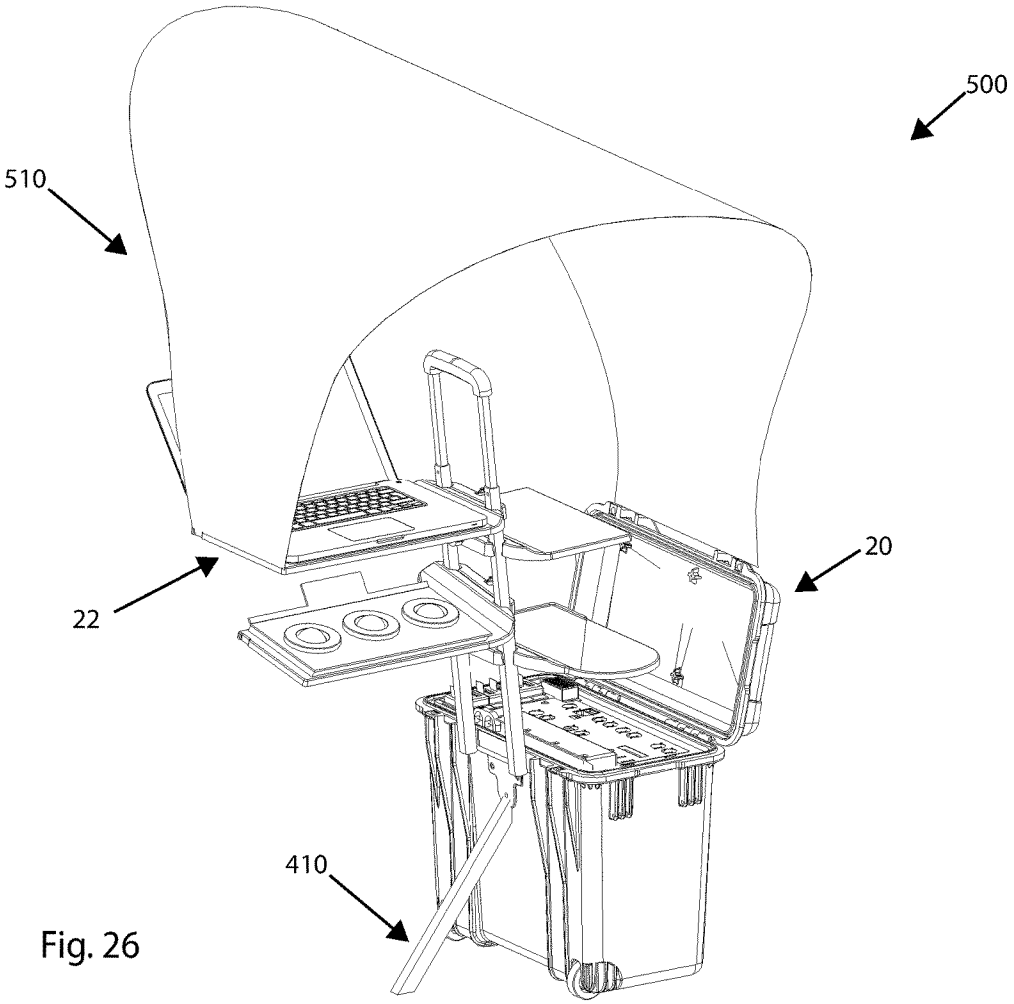
FIG. 26 is another perspective view of the work surface system in FIG. 23, but additionally showing a retractable support leg structure.

FIGS. 23-26 show another exemplary embodiment of the work surface system for carry-on cases, generally designated at 500, according to the present invention. System 500 is the same as described above for system 300 of FIGS. 18-20, except that system 500 further includes a canopy or tent 510 releasably mounted to system 500 for protecting system 500 from the elements, including sunlight and rain. Tent 510 is removably mounted at one side portion 515 thereof to lid 20 and at another side portion 520 there of to work surface 22. Conventional techniques (e.g., screws threaded in holes) may be used for mounting tent 510 to lid 20 and work surface 22 without departing from the spirit and scope of the invention. FIG. 25 shows a user 550 positioned relative to system 500 during use. FIG. 26 further incorporates into system 500 leg support 410 which has the same structure and functions as described above for the embodiment of FIGS. 21-22.

The work surfaces of the systems described above with each of the exemplary embodiment are preferably made of a material which is light-weight, yet durable in construction. For example, the work surfaces may be made of a rigid carbon fiber material. Alternatively, the work surfaces may be made so that it is not substantially rigid, such having a construction which is foldable with small aluminum rods and a polyester fabric.

The specific materials and constructions for the carry-on case, including case 12, lid 20 and pull-out handles 14 may be selected from a variety of known materials and constructions. Case 12, for example, may be particularly constructed as a hard case with suitable padding and other protective features, as is well known in the art, for accommodating there in a hard disk system other electronic device requiring similar protection from damage during movement of the carry-on case. Leg support 410 may be constructed of a suitable rigid, high-strength material, such as steel, aluminum, aluminum alloys, and high-strength plastic materials. Tent 510 may be constructed of a suitable waterproof fabric material with sufficient strength to withstand the elements, including exposure to rain and sunlight.

It will be appreciated that each work surface forming part of the system is not only universal in its coupling to existing carry-on cases, but is also substantially dimensioned and stable enough to support various types of electronic devices, such as a portable computer, mouse, keyboards, etc.

The work surfaces are advantageously configured to be removably attached to one or more pull-out handles common to a wide variety of wheeled carry-on cases by engaging outer surfaces of the pull-out handles. The work surfaces may be universally app lied to existing handle structures, whether formed of a single or a plurality of pull-out handles.

The work surface system of the present invention is particularly adapted for use with a hard drive carry-on case having pull-out hand les and wheels and configured to store a hard disk system for use in film production, for example. The work surfaces of the system removably attach to one or more of the pull-out handles for supporting various electronic devices, such as a portable computer (laptop) that is used with the stored hard disk system. Hard disk systems with long battery run times (e.g., greater than 6 hours) may be employed with the system which can be easily and conveniently transported everywhere by a single person.

The work surfaces can be readily removably attached and mated with the pull-out handles of the carry-on case using a quick lock clamp structure, such as including the hand knob described above. Another variation of the quick lock clamp structure may include a latch. Another variation may additionally allow adjustment of the clamping size to permit the work surface to fit in all segments of the pull-out handles, from the thinner portions to the thicker portions of the handles.

Yet another, more advanced variation of the claim structure may be configured to adjust for a correction angle between the work surface and the pull-out handles of the carry-on case. In this regard, the tables are configured such that a compensation angle is provided with respect to the pull-out handles of the carry-on case in order for the work surfaces to be horizontal when they are removably attached (e.g., tightened) to the pull-out handles. For example, in certain existing carry-on cases, the pull-out handles extend approximately at a 6 degree angle in relation to the vertical. Any known mechanism which may be manipulated by the user to adjust the angle between the work surfaces and the pull-handles may be incorporated without departing from the spirit and scope of the invention.

The system of the present disclosure is configured such that the work surfaces, in conjunction with the resulting compensation angle described above, are structured and mounted to the pull-handles such that the resulting counterweights between the carry-on case (with contents) and work surfaces (with device s supported thereon) are balanced relative one another. Here, the leg support as described above may be deployed, as necessary, in case the weight of the carry-on case is insufficient to support the overall system (e.g., insufficient to counteract the weight of the work surfaces and devices supported thereon).

It will be appreciated from the foregoing description that the working surfaces can be quickly mounted to the carry-on case to a desired ergonomical position. For example, the mounting height for the work surfaces can be conveniently adjusted to conform to the optimal viewing height and angle for a screen of a laptop to be supported by the work surface, or to conform to an optimal height that allows the hand of the user to fall in naturally for manipulating a mouse or track balls for color correction supported by the work surface.

It will also be appreciated that the work surfaces of the system according to the present invention are also compact and easy to carry by a single person, such as in a backpack. Thus, the present disclosure provides a portable work surface system of minimum size and weight without sacrificing durability and ergonomic use. The work surface system is also more user friendly than existing rack mounted equipment carts as described above.

According to the present disclosure, the work surfaces are designed as tables for every specific application, such as a mouse table that comes closer to the user and is rounded, and a coloring trackball table that has a desired angle towards the user to achieve an ergonomic position.

The work surface system for carry-on cases disclosed herein may be used in various industries, such as in the movie and photography industries as a work station for carrying-and supporting electronic devices and systems pertinent to these industries, as well as may be used in connection with various other applications, such as a work station for use by travelers at airports (e.g., to support computing device such as a laptop), for military use by military personnel, for use during sporting events, for use during musical concerts, and for use during fundraising events, for example, without departing from the spirit and scope of the invention.

Various embodiments of the invention are described above in the Detailed Description of the Invention. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s).

The foregoing description of a preferred embodiment and best mode of the invention known to the applicants at the time of filing the application has been presented and is intended for the purposes of illustration and description. It is not intended to be exhaustive or limit the invention to the precise form disclosed and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated. Therefore, it is intended that the invention not be limited to the particular embodiments disclosed for carrying out this invention, but that the invention will include all embodiments falling within the scope of the appended claims.

What is claimed is:

1. A work surface adapted to be removably attachable to a retractable handle assembly of a portable work surface system, the work surface having a connecting assembly for removably attaching the work surface to the retractable handle assembly, the connecting assembly comprising:

a hand knob having a threaded element, a mounting member having a smooth bore for receiving the threaded element, a pair of first notched recesses formed at end portions of the mounting member, a pair of second notched recesses formed at one side surface of the work surface, and a threaded bore formed in the one side of the work surface between the second notched recesses, wherein the work surface is removably attached to the retractable assembly by the threaded element of the hand knob extending through the smooth bore of the mounting member and threadedly engaging the threaded bore of the work surface while the first and second pairs of notched recesses confront one another with portions of the retractable handle assembly interposed therebetween.

2. The work surface of claim 1, further comprising means for attaching one end of a tent to the work surface and attaching another end of the tent to the portable work surface system.

3. The work surface of claim 1, wherein the work surface is uniquely sized to be fitted onto the retractable handle assembly in a manner providing ergonomic use by a user of at least one of mouse, computer, documents, and track balls for color correction.

4. The work surface of claim 1, wherein the work surface is made of carbon fiber material.

5. The work surface of claim 1, wherein the work surface is made in part of a foldable material.

6. The work surface of claim 5, wherein the foldable material is a polyester fabric.

7. The work surface of claim 1, wherein a correction angle of the work surface relative to the retractable handle assembly is adjustable.

8. A work surface and tent combination adapted to be removably attachable to a retractable handle assembly of a portable work surface system, the work surface having a connecting assembly for removably attaching the work surface to the retractable handle assembly, the tent being configured to attach to the work surface at one end and at an opposite end to the portable work surface system, the connecting assembly comprising:

a hand knob having a threaded element, a mounting member having a smooth bore for receiving the threaded element, a pair of first notched recesses formed at end portions of the mounting member, a pair of second notched recesses formed at one side surface of the work surface, and a threaded bore formed in the one side of the work surface between the second notched recesses, wherein the work surface is removably attached to the retractable assembly by the threaded element of the hand knob extending through the smooth bore of the mounting member and threadedly engaging the threaded bore of the work surface while the first and second pairs of notched recesses confront one another with portions of the retractable handle assembly interposed therebetween.

9. The work surface and tent combination of claim 8, wherein the work surface is uniquely sized to be fitted onto the retractable handle assembly in a manner providing ergonomic use by a user of at least one of mouse, computer, documents, and track balls for color correction.

10. The work surface and tent combination face of claim 8, wherein the work surface is made of carbon fiber material.

11. The work surface and tent combination of claim 8, wherein the work surface is made in part of a foldable material.

12. The work surface and tent combination of claim 11, wherein the foldable material is a polyester fabric.

13. The work surface and tent combination of claim 8, wherein a correction angle of the work surface relative to the retractable handle assembly is adjustable.

14. A work surface and retractable leg combination adapted to be removably separately attachable to a portable work surface system, the work surface having a connecting assembly for removably attaching the work surface to a retractable handle assembly of the portable work surface system, the retractable leg being attachable to an outside surface of the portable work surface to stabilize the portable work surface system during use, the connecting assembly comprising:

a hand knob having a threaded element, a mounting member having a smooth bore for receiving the threaded element, a pair of first notched recesses formed at end portions of the mounting member, a pair of second notched recesses formed at one side surface of the work surface, and a threaded bore formed in the one side of the work surface between the second notched recesses, wherein the work surface is removably attached to the retractable assembly by the threaded element of the hand knob extending through the smooth bore of the mounting member and threadedly engaging the threaded bore of the work surface while the first and second pairs of notched recesses confront one another with portions of the retractable handle assembly interposed therebetween.

15. The work surface and retractable leg combination of claim 14, further comprising means for attaching one end of a tent to the work surface and attaching another end of the tent to the portable work surface system.

16. The work surface and retractable leg combination of claim 14, wherein the work surface is made of carbon fiber material.

17. The work surface and retractable leg combination of claim 14, wherein a correction angle of the work surface relative to the retractable handle assembly is adjustable.

* * * * *